US008391735B2

(12) United States Patent
Kuramochi et al.

(10) Patent No.: US 8,391,735 B2
(45) Date of Patent: Mar. 5, 2013

(54) RECORDING MATERIAL DETERMINATION APPARATUS AND IMAGE FORMING APPARATUS

(75) Inventors: Yoshimi Kuramochi, Mishimi (JP); Shoji Maruyama, Suntou-gun (JP); Tsutomu Ishida, Mishima (JP); Shunichi Ebihara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/232,832

(22) Filed: Sep. 14, 2011

(65) Prior Publication Data

US 2012/0002988 A1 Jan. 5, 2012

Related U.S. Application Data

(63) Continuation of application No. 12/147,377, filed on Jun. 26, 2008, now Pat. No. 8,045,868.

(30) Foreign Application Priority Data

Jun. 27, 2007 (JP) ..... 2007-169352

(51) Int. Cl.
*G03G 15/00* (2006.01)

(52) U.S. Cl. ..... 399/45; 399/389

(58) Field of Classification Search ..... 399/45, 399/46

See application file for complete search history.

(56) References Cited

U.S. PATENT DOCUMENTS 7,072,595 B2 * 7/2006 Joichi et al. ..... 399/45
2003/0128265 A1 * 7/2003 Barbehenn ..... 347/105

* cited by examiner

*Primary Examiner* — David Gray
*Assistant Examiner* — Gregory H Curran
(74) *Attorney, Agent, or Firm* — Canon USA Inc. IP Division

(57) ABSTRACT

A recording material determination apparatus includes a first detection unit configured to detect a characteristic corresponding to a surface condition of a recording material based on a captured image of a surface of the recording material, a second detection unit configured to detect a characteristic corresponding to a grammage of the recording material based on an ultrasonic wave detected via the recording material by irradiating the recording material with an ultrasonic wave, and a conveyance unit configured to convey the recording material. The first detection unit and the second detection unit are located opposite each other with respect to the conveyance unit.

21 Claims, 19 Drawing Sheets

RECORDING MATERIAL DETERMINATION APPARATUS AND IMAGE FORMING APPARATUS

CROSS-REFERENCE TO RELATED APPLICATIONS

This application is a Continuation of U.S. patent application Ser. No. 12/147,377 filed Jun. 26, 2008, which claims priority from Japanese Patent Application No. 2007-169352 filed Jun. 27, 2007, the entire contents of both which are hereby incorporated by reference in their entireties.

BACKGROUND OF THE INVENTION

1. Field of the Invention

The present invention relates to a recording material determination apparatus and to an image forming apparatus to which the recording material determination apparatus is applied. More particularly, the present invention relates to a recording material determination apparatus configured to determine the type of a recording material using a sensor that determines a surface condition of the recording material and a sensor that determines a grammage of the recording material, and to an image forming apparatus to which the recording material determination apparatus is applied.

2. Description of the Related Art

Generally, an image forming apparatus, such as a copying machine or laser printer, forms a toner image on a photosensitive drum, serving as an image carrier, using toner, serving as a developer, and transfers the formed toner image onto a recording material. Then, the image forming apparatus fixes the toner image transferred to the recording material by heating and pressing the toner image under predetermined conditions. The predetermined conditions include a temperature to be set according to the type of a recording material (e.g., a quality, a thickness, a grammage, and a surface condition of the recording material) and a speed of conveying the recording material. Thus, the quality of an image formed according to the type of the recording material is maintained. That is, in the case of forming an image on a recording material, the type of the recording material may be determined before forming (printing) the image on the recording material. By doing so, fixing conditions may be more precisely set according to the determined type of the recording material.

Conventionally, in an image forming apparatus, the type (e.g., gloss paper (glossy paper), cardboard, thin paper, plain paper, overhead transparency (OHT)) of the recording material is set by a user via an operation panel provided on the apparatus. The fixing conditions can be changed according to user settings.

Some recent image forming apparatuses incorporate a recording material determination sensor and have the function of automatically determining the type of a recording material supplied thereinto using the sensor, in addition to the function of determining the type of a recording material based on user settings. Additionally, the recent image forming apparatuses variably control the fixing conditions according to the type of the recording material, which is determined by the sensor. The conditions that are variably controlled according to the type of the recording material are not limited to the fixing conditions. Developing conditions for developing a toner image on the photosensitive drum and transfer conditions for transferring the toner image to the recording material can be variably controlled according to the type of the recording material.

Some image forming apparatuses automatically determine the type of a recording material by, e.g., capturing a surface image of the recording material using a charge-coupled device (CCD) sensor or a complementary metal oxide semiconductor (CMOS) sensor and determining the surface condition of the recording material using the captured image data. Such image forming apparatuses determine the type of a recording material using a method of detecting the smoothness of a surface of the recording material according to the magnitude correlation among the densities of pixels represented by the captured image data. Japanese Patent Application Laid-Open No. 2005-128004 discusses another method of determining the thickness or grammage of a recording material according to an amount of light transmitted through the recording material.

However, particularly, in a case where the grammage of a recording material is determined, the determination accuracy in the conventional method may be insufficient. For example, according to a conventional method of determining the thickness of a recording material based on an amount of transmitted light, even when the thickness of the recording material has the same value, the transmitted light can vary depending upon the whiteness degree, the color, and the fiber density of the recording material. That is, according to the conventional method using the amount of transmitted light, the thickness of the recording material can be determined with a certain level of accuracy. However, it is difficult to finely determine the grammage of a recording material. Note that the "grammage" of a recording material is defined as a weight of a sheet of the recording material in the units of gram per square meters ($g/m^2$).

Japanese Patent Application Laid-Open No. 2004-107030 discusses a method of determining the type of a recording material, such as paper, by detecting an ultrasonic wave reflected from the recording material, and a method of determining the thickness of a recording material by detecting an ultrasonic wave transmitted through the recording material.

Japanese Patent Application Laid-Open No. 2004-107030 discusses also an apparatus in which an ultrasonic transmitter is provided on one of sides of a recording material while an ultrasonic receiver is provided on the other side of the recording material. The ultrasonic transmitter irradiates an ultrasonic wave to the recording material to vibrate the recording material. The ultrasonic receiver receives an ultrasonic wave transmitted through the recording material due to the vibration of the recording material. Then, the thickness of the recording material is determined according to a signal corresponding to the received ultrasonic wave.

When the type of a recording material is determined, the type of the recording material can be determined in more detail by finally determining the type of the recording material using both a result of determining the thickness or grammage thereof and a result of determining the surface condition thereof.

Thus, it is considered that the type of a recording material can be determined by employing both the method discussed in Japanese Patent Application Laid-Open No. 2004-107030 to determine the thickness or grammage of the recording material and the method discussed in Japanese Patent Application Laid-Open No. -04 to determine the surface condition of the recording material.

However, in a case where detection operations are substantially simultaneously performed using both the methods, when an image of a surface of a recording material is captured by a CCD sensor or a CMOS sensor to determine the surface condition of the recording material, an image is captured in a state in which the recording material is vibrated with an ultrasonic wave. That is, the surface of the vibrated recording material is captured. Thus, there is a possibility that an unfocused image of the surface of the recording material is captured. In a case where a smoothness representing the surface condition of the recording material is detected according to the unfocused image of the surface of the recording material, the type of the recording material may be misdetermined.

In a case where the type of the recording material is misdetermined, e.g., where gloss paper (glossy paper) is misdetermined as plain paper, fixing conditions irrelevant to the correct type of the recording material are set. Accordingly, it is assumed that the picture quality of the image is degraded.

On the other hand, recently, more various types of recording materials are used by users. Accordingly, it is desired to more accurately determine the type of a recording material so as to appropriately set image forming conditions according to the type of the recording material.

SUMMARY OF THE INVENTION

An embodiment of the present invention is directed to a recording material determination apparatus capable of correctly determining the type of a recording material in a case where the type of the recording material is determined using a plurality of recording material determination methods, and to an image forming apparatus using the recording material determination apparatus.

More particularly, an embodiment of the present invention is directed to a recording material determination apparatus capable of reducing, in a case where the type of a recording material is determined using both a method of determining the type of a recording material by irradiating an ultrasonic wave to a recording material and another method of determining the type of a recording material by capturing a surface image of the recording material, a determination time and correctly determining the type of the recording material, and to an image forming apparatus using the recording material determination apparatus.

According to an aspect of the present invention, a recording material determination apparatus includes a first detection unit configured to detect a characteristic corresponding to a surface condition of a recording material based on a captured image of a surface of the recording material, a second detection unit configured to detect a characteristic corresponding to a grammage of the recording material based on an ultrasonic wave detected via the recording material by irradiating the recording material with an ultrasonic wave, and a conveyance unit configured to convey the recording material. The first detection unit and the second detection unit are located opposite each other with respect to the conveyance unit.

According to another aspect of the present invention, an image forming apparatus includes an image forming unit configured to form an image on a recording material, a conveyance unit configured to convey the recording material to the image forming unit, a first detection unit configured to detect a characteristic corresponding to a surface condition of the recording material based on a captured image of a surface of the recording material, a second detection unit configured to detect a characteristic corresponding to a grammage of the recording material based on an ultrasonic wave detected via the recording material by irradiating the recording material with an ultrasonic wave. The first detection unit and the second detection unit are located opposite each other with respect to the conveyance unit. An image forming condition of the image forming unit is set based on results of detections performed by the first detection unit and the second detection unit.

According to still another aspect of the present invention, a recording material determination apparatus includes a first detection unit configured to detect a characteristic corresponding to a surface condition of a recording material based on a captured image of a surface of the recording material, and a second detection unit configured to detect a characteristic corresponding to a grammage of the recording material based on an ultrasonic wave detected via the recording material by irradiating the recording material with an ultrasonic wave. A detection operation by the first detection unit and a detection operation by the second detection unit are performed at different timings.

According to yet another aspect of the present invention, an image forming apparatus includes an image forming unit configured to form an image on a recording material, a conveyance unit configured to convey the recording material to the image forming unit, a first detection unit configured to detect a characteristic corresponding to a surface condition of the recording material based on a captured image of a surface of the recording material, and a second detection unit configured to detect a characteristic corresponding to a grammage of the recording material based on an ultrasonic wave detected via the recording material by irradiating the recording material with an ultrasonic wave. A detection operation by the first detection unit and a detection operation by the second detection unit are performed at different timings. An image forming condition of the image forming unit is set based on results of detections performed by the first detection unit and the second detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
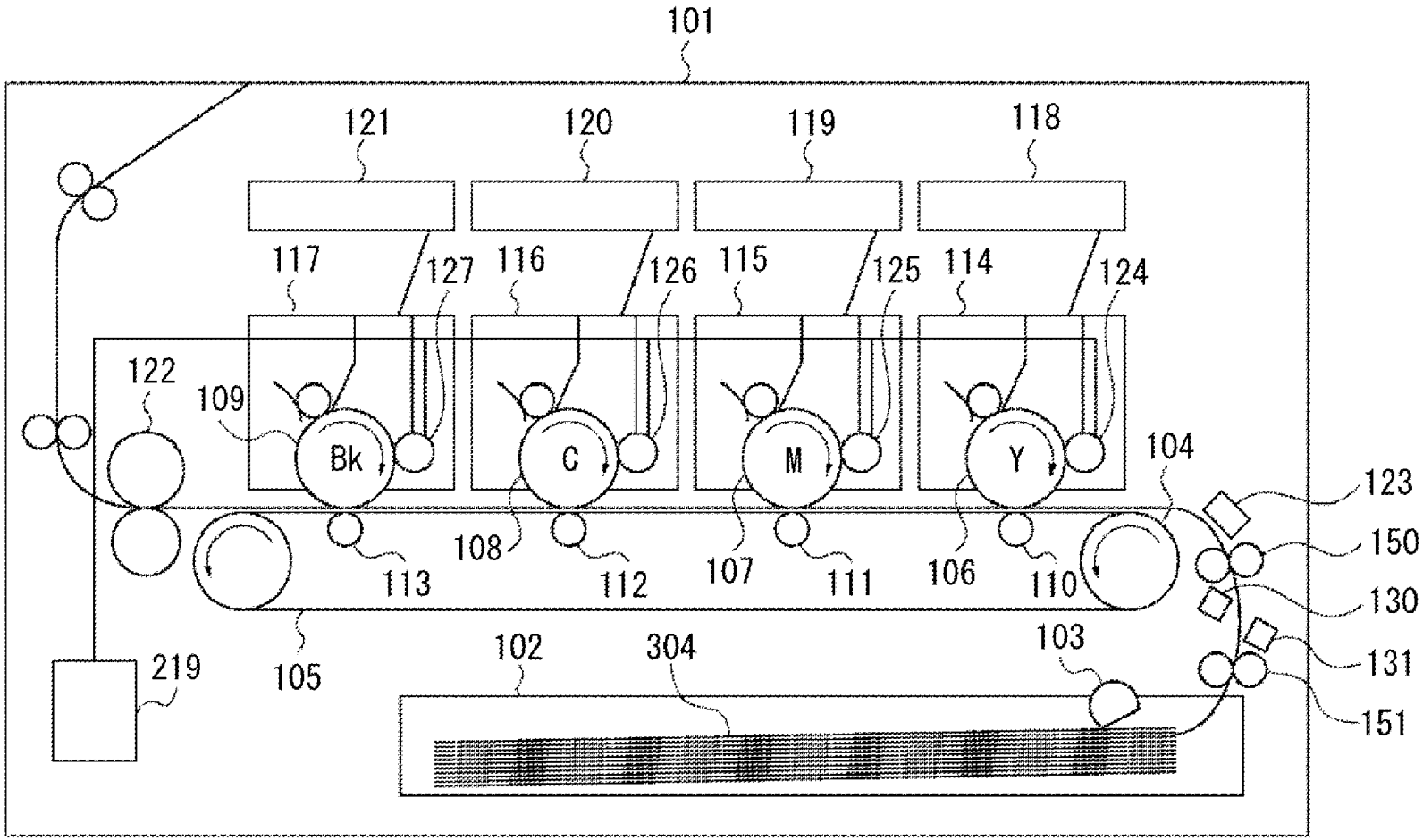
FIG. 1 illustrates a configuration of an image forming apparatus according an exemplary embodiment of the present invention.

FIG. 1 illustrates a configuration of an image forming apparatus according an exemplary embodiment of the present invention. As illustrated in FIG. 1, an image forming apparatus 101 includes a cassette 102, which accommodates sheets of paper (recording material 304), a roller 103, which feeds sheets of paper, a drive roller 104, which drives a transfer belt, a transfer belt 105, photosensitive drums 106 to 109, which are used to form yellow, magenta, cyan, and black images, respectively. The image forming apparatus 101 further includes transfer rollers 110 to 113, each of which transfers an image formed on an associated one of the photosensitive drums onto the recording material, and cartridges 114 to 117, each of which includes an associated one of the photosensitive drums and an associated one of developing rollers 124 to 127. The image forming apparatus 101 further includes optical units 118 to 121, each of which corresponds to an associated one of the colors, and a fixing unit 122.

The image forming apparatus 101 uses an electrophotographic process, and transfers yellow, magenta, cyan, and black images onto a recording material by superimposing the images. The toner images transferred onto the recording material are thermally fixed thereto by the fixing unit 122. Each of the optical units 118 to 121 scans the surface of an associated one of the photosensitive drums 106 to 109 with laser beams, and exposes the surface of the associated photosensitive drum to form an electrostatic latent image thereon. A sequence of such image forming operations is performed by synchronizing a timing, at which an image is formed on each of the photosensitive drums, with a timing at which the recording material is conveyed, so that an image is transferred from a predetermined position on the recording material to be conveyed.

The image forming apparatus further 101 includes a motor 216 (FIG. 2) for feeding and conveying the recording material (a sheet of paper) from the cassette 102. Images are formed on the surface of the sheet of paper while the fed sheet of paper is conveyed to a fixing roller via a transfer belt.

An ultrasonic transmitter 130 and an ultrasonic receiver 131, which serve as an ultrasonic sensor, are arranged at the upstream side in a direction of conveying the recording material with respect to a conveyance roller 150. The ultrasonic transmitter 130 irradiates an ultrasonic wave onto the recording material 304 having been conveyed thereto. Then, the ultrasonic receiver 131 receives an ultrasonic wave from the recording material 304.

A reading sensor 123 for determining a surface condition of a recording material is arranged at the downstream side in the direction of conveying the recording material with respect to the conveyance roller 150. The reading sensor 123 irradiates light on the surface of the recording material having been conveyed thereto. Reflection light obtained by reflecting the irradiated light is focused and formed into an image. Then, the image is read by the CMOS sensor. Thus, image data representing a specific area of the surface of the recording material is detected.

Figure 2:
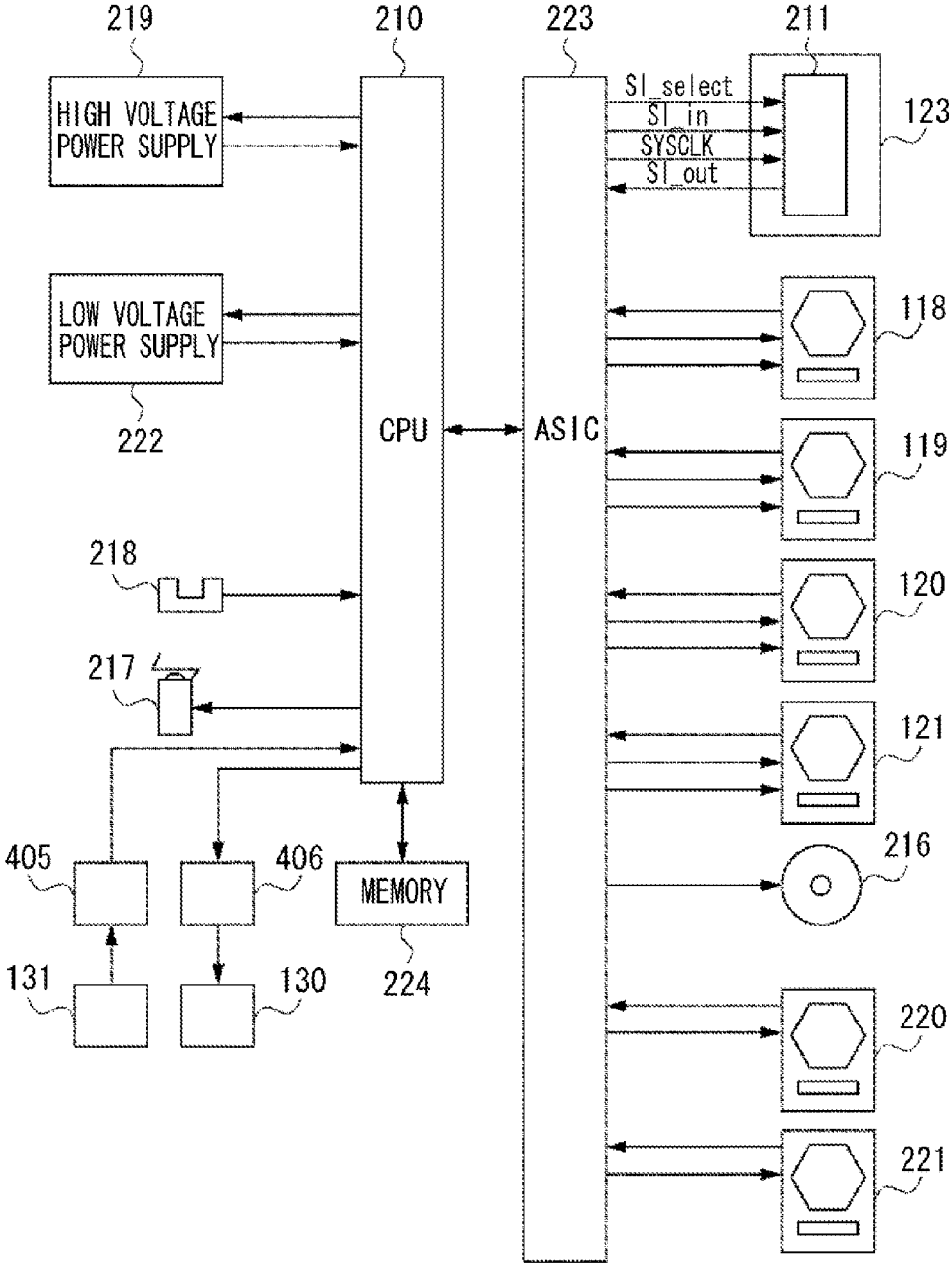
FIG. 2 illustrates a control operation of a central processing unit (CPU) of the image forming apparatus according to an exemplary embodiment of the present invention.

An operation of a control unit of the image forming apparatus 101 is described below with reference to FIG. 2. FIG. 2 illustrates the configuration of each unit to be controlled by a CPU 210. As illustrated in FIG. 2, the CPU 210 is connected to an application specific integrated circuit (ASIC) 223. The CPU 210 is connected to the CMOS area sensor 211 of the reading sensor 123 and each of the optical units respectively corresponding to the colors via the ASIC 223. Each of the optical units includes a polygonal mirror (not shown), a motor (not shown), which drives the polygonal mirror, a laser chip (not shown), and a control circuit (not shown) for controlling an operation of the motor and a laser irradiation timing.

The CPU 210 controls a high voltage power supply 219, which outputs a charged voltage, a developing voltage, and a transfer voltage, which are needed for the electrophotographic process, and a low voltage power supply 222, which supplies electric power to the fixing unit 122. According to an instruction from the CPU 210, the ASIC 223 controls the optical units for drawing an electrostatic latent image by irradiating beams irradiated from the optical unit onto a surface of the photosensitive drum. Additionally, the ASIC 223 controls operations of a motor 216 for feeding and conveying recording materials, a drive motor 220 for driving the photosensitive drums and the transfer rollers, and a drive motor 221 for driving the transfer belt and the roller of the fixing unit 122.

The CPU 210 has functions of controlling operations of the reading sensor 123, the ultrasonic transmitter 130, and the ultrasonic receiver 131, which serve as an ultrasonic sensor, and determining the type of a recording material according to results of detection by such sensors.

The CPU 210 is connected to a memory 224 via a bus (not shown). The memory 224 stores programs and data, which are used for performing all or part of processing to be performed by the CPU 210 in the control operation and in each exemplary embodiment. That is, the CPU 210 performs an operation of each exemplary embodiment of the present invention using the programs and the data stored in the memory 224.

The ASIC 223 controls the reading sensor 123, the speed of the motor provided in each of the optical units 212 to 215, and that of each of the motor 216 and the drive motors 220 and 221 for feeding and conveying the recording material, based on an instruction from the CPU 210. The ASIC 223 controls the speed of each of these motors by detecting tack signals (a predetermined number of signals output per revolution thereof) output therefrom and by outputting signals to cause an associated one of the motors to accelerate or decelerate so that the interval between the tack signals is a predetermined time. In order to support such a control operation, the ASIC 223 is constituted by a hardware control circuit. Thus, a control load on the CPU 210 is reduced as much as possible.

When receiving a print command from a host computer (not shown), the CPU 210 uses a presence/absence sensor 218 (sensor which determines the presence or absence of a recording material in the cassette 102 illustrated in FIG. 1) to determine the presence or absence of a recording material therein. If determining that paper is present, the CPU 210 drives the motor 216 and the drive motors 220 and 221 and drives also a solenoid 217 to convey the recording material 304 to a predetermined position.

When the recording material 304 is conveyed to a position between the ultrasonic transmitter 130 and the ultrasonic receiver 131, the CPU 210 drives the ultrasonic transmitter 130 via a transmitting circuit 406 to output an ultrasonic wave. The frequency of output ultrasonic wave is preliminarily determined. In the present embodiment, e.g., a frequency of 40 MHz is set. The recording material 304 is vibrated by the ultrasonic wave. Then, the ultrasonic receiver 131 receives an ultrasonic wave from the recording material 304 and sends a reception signal to the CPU 210 via a receiving circuit 405. The CPU 210 determines a grammage of the recording material 304 according to the reception signal.

The reading sensor 123 for detecting the surface condition of the recording material 304 is provided at the downstream side in the direction of conveying the recording material 304 with respect to the conveyance roller 150. The recording material 304 is conveyed to the position of the reading sensor 123. Then, the recording material 304 is once stopped. An image of the surface of the recording material 304 is captured. The surface condition of the recording material 304 is then determined based on the captured image.

Thus, a first characteristic and a second characteristic of the recording material, which respectively correspond to the surface condition and the grammage, are detected using the reading sensor and the ultrasonic sensor.

Then, the CPU 210 determines the surface condition of the recording material 304 using the reading sensor 123. In addition, the CPU 210 determines the grammage of the recording material 304 using the ultrasonic transmitter 130 and the ultrasonic receiver 131. According to detection results, the CPU 210 controls or changes conditions for voltages output from the high voltage power supply 219.

For example, in a case where surface fibers of the recording material are in a rough state, i.e., in the case of rough paper, the CPU 210 performs a control operation such that a voltage to be applied during development is lowered to reduce an amount of toner adhering to the surface of the recording material and to prevent toner from being scattered. Particularly, in the case of rough paper, an amount of toner adhering to the surface of the recording material is large. Thus, this control operation is performed to prevent the picture quality of an image from being degraded by the scattering of toner, which is caused by the paper fibers.

The CPU 210 determines the grammage of the recording material 304 and controls conditions for outputting a transfer voltage from the high voltage power supply 219 according to a result of the determination of the grammage.

The recording material 304 having a large grammage is large in electric capacity. Thus, it is necessary to increase the transfer voltage to a certain large value. Conversely, in the case of using the recording material 304 having a small grammage, the transfer voltage is set at a low value so as to prevent an image defect, which may be caused in a case where the voltage applied during transfer of an image is too high, from being caused, in comparison with the value of the transfer voltage in the case of using the recording material 304 having a large grammage.

The CPU 210 determines the surface condition of the recording material 304 and controls conditions for setting a temperature of the fixing unit 222 according to a result of the determination of the surface condition. For example, in the case of rough paper, the surface fibers are coarse. Accordingly, it is expected that the ability to fusion-bond the toner to the paper is low. Thus, a fixing temperature of toner can be changed to appropriately fusion-bond the toner to the paper. In a case where the recording material is OHT, the fixability of toner to a surface of the recording material, i.e., OHT, is lower than those of toner to other ordinary recording materials. Thus, the fixability of toner to OHT is improved by setting the fixing temperature of the toner to OHT at a high value.

In addition, the CPU 210 determines the grammage of the recording material 304 and controls and changes the speed of conveying the recording material 304 according to a result of the determination of the grammage. The control of the speed of conveying the recording material 304 is implemented by causing the CPU 210 to change a set value of a speed control register (not shown) in the ASIC 223, which actually controls the speed of conveying the recording material 304. The fixing temperature conditions corresponding to a recording material having a certain grammage are changed from those corresponding to another recording material having a different fixing grammage. For example, a recording material having a large grammage is high in heat capacity. Thus, the fixing temperature corresponding to this recording material is set to be relatively high. On the other hand, toner is fixed to a recording material having a small grammage, i.e., having a low heat capacity, by setting the fixing temperature relatively low. Alternatively, the speed of conveying the recording material can be controlled and changed according to the grammage of the recording material.

In a case where the recording material 304 is gloss paper (glossy paper), picture quality can be improved by enhancing the fixability of toner to a surface of the recording material 304 to increase the glossiness of the recording material 304.

The surface condition of a recording material is determined using the CMOS area sensor 211. The grammage of the recording material is determined using the ultrasonic transmitter 130 and the ultrasonic receiver 131. According to results of determinations of the surface condition and the grammage, the voltage output from the high voltage power supply 219 can be controlled. In addition, the fixing temperature conditions of the fixing unit 122 or the speed of conveying the recording material at fixation in the fixing unit 122 can be controlled and changed.

First Exemplary Embodiment

Figure 3:
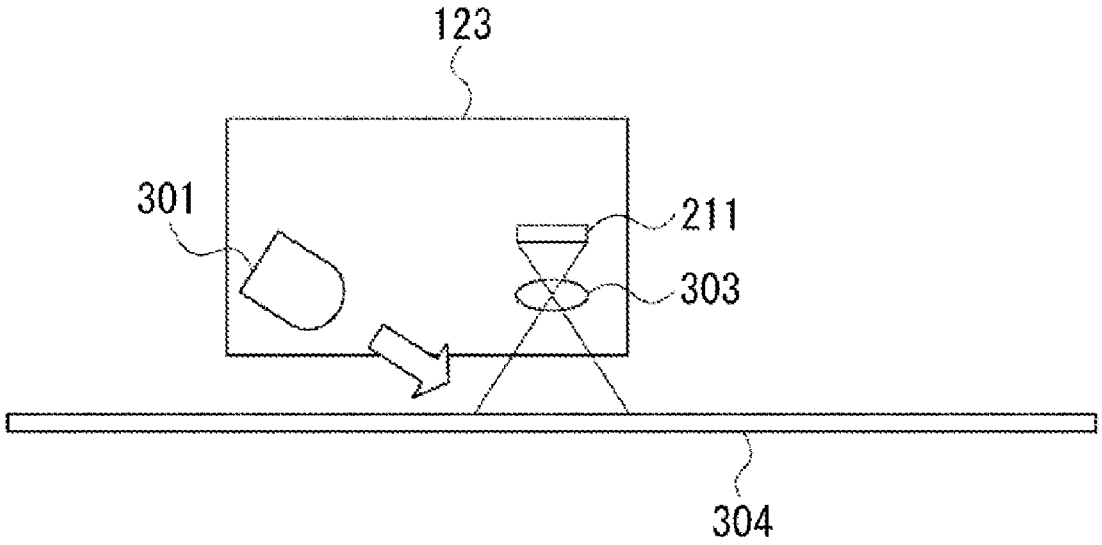
FIG. 3 illustrates a configuration of a reading sensor for determining a surface condition of a recording material.
Figure 4:
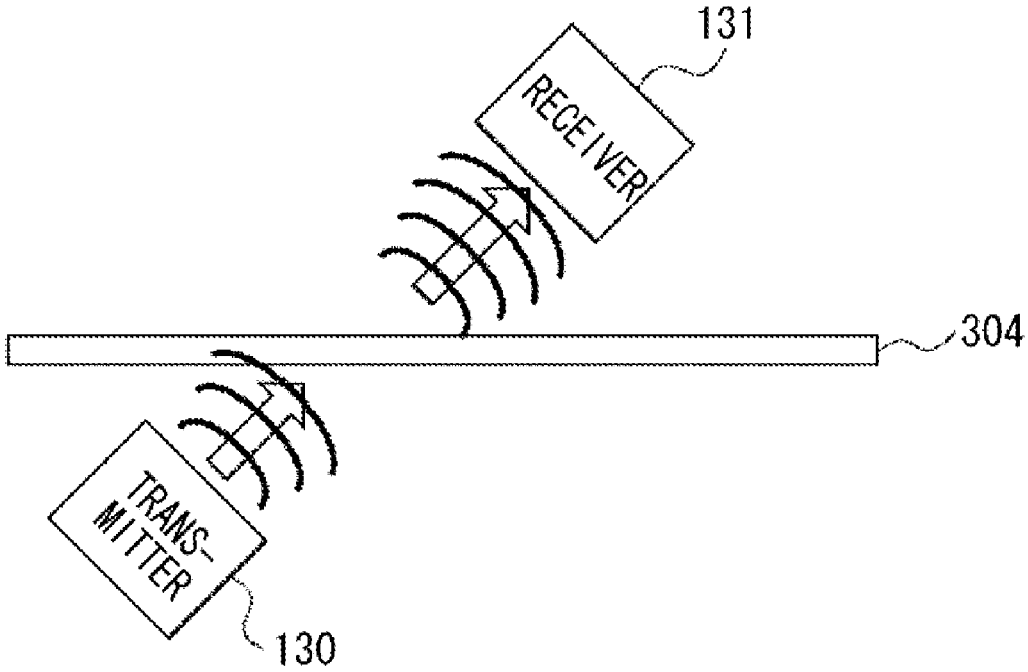
FIG. 4 illustrates a configuration of an ultrasonic sensor for determining a grammage of a recording material.

Next, a recording material determination apparatus according to an exemplary embodiment of the present invention is described below. FIG. 3 illustrates a configuration of a reading sensor for determining a surface condition of a recording material. FIG. 4 illustrates a configuration of an ultrasonic sensor for determining a grammage of a recording material.

As illustrated in FIG. 3, the reading sensor 123 for determining the surface condition of a recording material includes a light emitting diode (LED) 301 for irradiating light, a CMOS area sensor 211 for capturing an image, and an imaging lens 303. Incidentally, an image can be captured using a CCD sensor instead of the CMOS area sensor 211.

Light emitted from the LED 301 serving as a light source is irradiated to a surface of the recording material 304. Reflection light reflected from the recording material 304 is focused via the lens 303 and is formed into an image on the CMOS area sensor 211. Consequently, an image of the surface of the recording material 304 can be read. According to the present embodiment, the LED 301 is used as the light source. Alternatively, e.g., a xenon tube or a halogen lamp can be used as the light source.

In the present embodiment, the LED 301 is located such that light from the LED 301 is irradiated obliquely to a surface of the recording material 304 at a predetermined angle, as illustrated in FIG. 3.

As illustrated in FIG. 4, the ultrasonic transmitter 130 and the ultrasonic receiver 131, which serve as an ultrasonic sensor for determining the grammage of the recording material 304, are located opposite each other across the recording material 304. An ultrasonic wave transmitted from the ultrasonic transmitter 130 reaches the recording material 304 and causes the recording material 304 to vibrate. Then, an ultrasonic wave transmitted through the recording material 304 is received by the ultrasonic receiver 131.

In the present embodiment, the ultrasonic transmitter 130 and the ultrasonic receiver 131 are located such that an ultrasonic wave is obliquely irradiated onto the recording material 304 at a predetermined angle.

Figure 5:
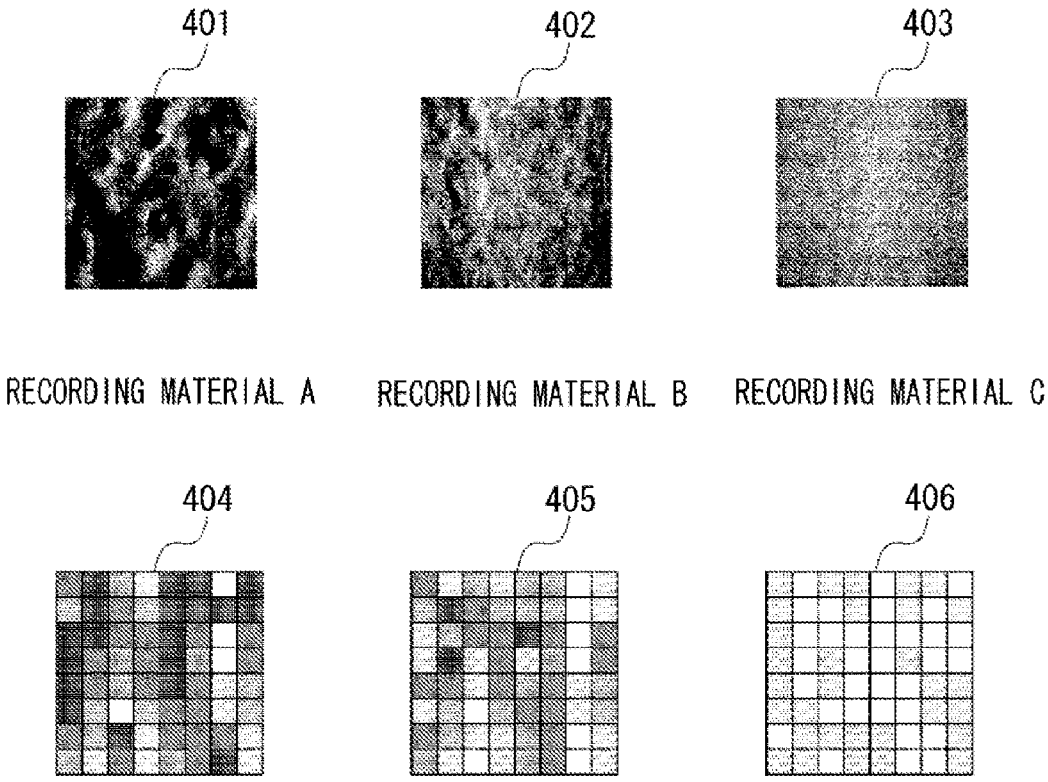
FIG. 5 illustrates analog images of surfaces of recording materials, which are read by a reading sensor, in contrast with digital images obtained by performing digital processing on the analog images, respectively.

FIG. 5 illustrates analog images of surfaces of recording materials 304, which are read by the CMOS area sensor 211 of the image reading sensor 123 in contrast with digital images obtained by performing digital processing on the analog images output from the CMOS area sensor 211, which are converted into 8×8 pixels, respectively. The digital processing is implemented by performing an A/D conversion on the analog outputs from the CMOS area 211 and converting the analog outputs into 8-bit pixel data.

Referring to FIG. 5, a recording material A 401 is rough paper with a surface having relatively rough paper fiber (i.e., the word "rough" means that the smoothness of a surface thereof is low). A recording material B 402 is plain paper commonly used (the smoothness thereof is higher than that of rough paper). A recording material C 403 is gloss paper (glossy paper) adapted so that paper fibers thereof are sufficiently compressed (the smoothness of gloss paper is higher than that of plain paper). The surfaces of the recording materials A, B, and C are enlargedly illustrated. Images 401 to 403 are read by the reading sensor 123 and are subjected to digital processing. Consequently, the images 401 to 403 are converted into images 404 to 406, respectively, as illustrated in FIG. 5. Thus, the images of the surfaces differ from one another according to the type of the recording material. This phenomenon occurs mainly due to differences in the state of the surface fibers of paper.

Generally, a total or an average of the quantities of light input to pixels of the digitalized image is calculated. Thus, the surface condition is determined.

As described above, the image of the surface of the recording material is captured by the CMOS area sensor 211. Then, a digital image is obtained by performing digital processing on the captured image. The differences in the state of the surface fibers (or the surface condition) among the recording materials are discriminated according to the digital images. Thus, the state of the surface fibers (or the surface condition) can be utilized as a parameter for determination of the type of the recording material.

A practical method of discriminating the surface of the recording material is to detect the density $D_{max}$ of a pixel, which is the highest density, and the density $D_{min}$ of a pixel, which is the lowest density, in each line of the digital image represented by digital image data and to compute the difference between the density $D_{max}$ and the density $D_{min}$ in each line thereof. The smoothness of the recording material can be determined according to the value obtained by averaging results of computation performed on a plurality of lines. In the case of the above-described example, the image data includes 8×8 pixels. Thus, data of 8 lines can be obtained.

That is, in a case where the state of paper fibers of the surface of the recording material, such as the recording material A, is rough, the shadows of many fibers are caused. Consequently, the difference (in the density) between a light place and a dark place is large. Thus, the value of $(D_{max}-D_{min})$ is large. On the other hand, in a case where the paper fibers of the high-smoothness recording material, such as the recording material C, are sufficiently compressed, the shadows of the fibers are scarcely caused. Consequently, the difference (in the density) between a light place and a dark place is small. Thus, the value of $(D_{max}-D_{min})$ is small. The smoothness of the recording material is determined according to this comparison. Consequently, the apparatus can determine which of rough paper, plain paper, and gloss paper (glossy paper) the recording material is.

The above-described control processor is required to perform sampling processing on analog images obtained from the CMOS area sensor 211, setting of the gain of each of the sensors, and filter calculation processing in real time. Therefore, it is desirable to use devices, such as a dedicated digital signal processor capable of performing high-speed calculation processing.

Next, a method of detecting the grammage of the recording material using the ultrasonic sensor is described below.

As illustrated in FIGS. 2 and 4, the CPU 210 drives the ultrasonic transmitter 130 to cause the transmitting circuit 406 to output an ultrasonic wave. Then, the output ultrasonic wave reaches and vibrated the recording material 304. Then, an ultrasonic wave output from the recording material 304 is received by the ultrasonic receiver 131. Then, the received signal is sent to the CPU 210 via the receiving circuit 405 of the ultrasonic receiver 131.

Figure 6:
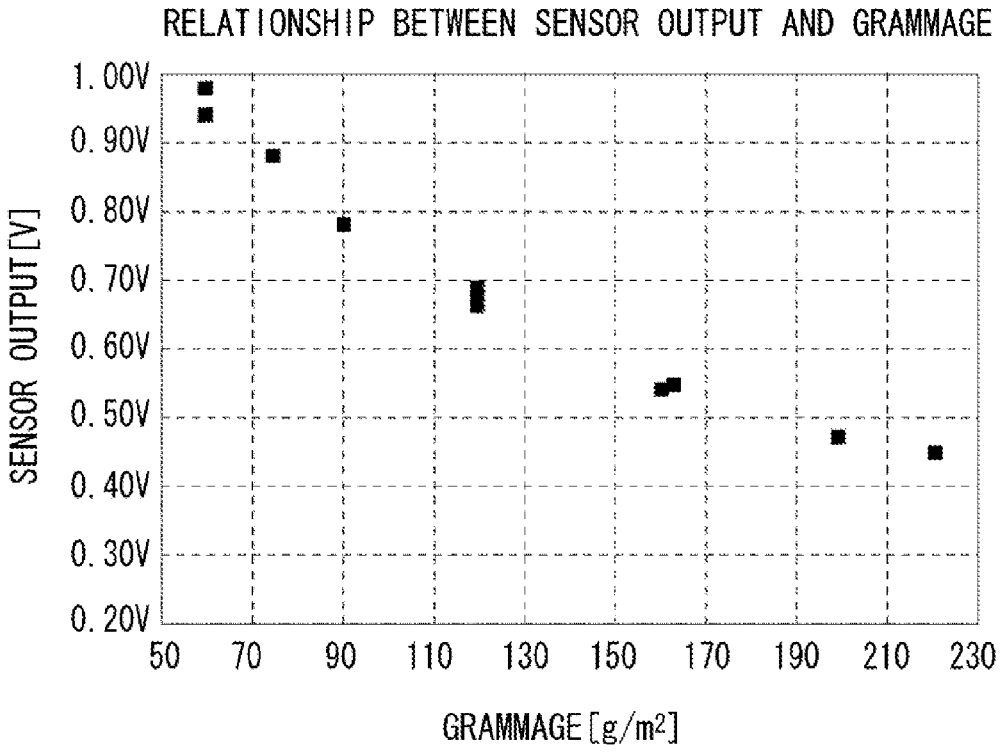
FIG. 6 illustrates a relationship between a grammage of a recording material and a received ultrasonic signal.

FIG. 6 illustrates a relationship between the grammage of the recording material and the received ultrasonic signal. For example, in a case where a recording material having a large grammage is used, the voltage value of the received signal is low. On the other hand, in a case where a recording material having a small grammage is used, the voltage value of the received signal is high. According to such a property, the grammage, which is one of attributes of the recording material, is determined. The grammage is used as a parameter for determining the type of the recording material.

Generally, there are the following types (1) to (7) of a recording material. The type of a recording material is determined according to the surface condition and the grammage of the recording material, as described below. The "grammage" of a recording material is defined to be the weight of a sheet of the recording material per square meters (in units of $g/m^2$).

(1) thin paper (grammage: 64 $g/m^2$ or less)
(2) plain paper (grammage: 65 to 105 $g/m^2$)
(3) cardboard 1 (grammage: 106 to 135 $g/m^2$)
(4) cardboard 2 (grammage: 136 $g/m^2$ or greater)
(5) gloss paper (glossy paper)
(6) gloss film
(7) OHT sheet In the case of determining which of the types (1) to (7) the type of the recording material is, first, it is determined according to the quantity of reflection light from the recording material whether the recording material is of the type (7), i.e., OHT sheet. The OHT sheet of the type (7) is transparent. Thus, the transmissivity of the OHT sheet is considerably higher than those of the recording materials of the other types (1) to (6). That is, the quantity of light reflected by the recording material of the type (7) is considerably lower than those of the recording materials of the other types (1) to (6). Therefore, it can be determined according to the quantity of light reflected by the recording material whether the recording material is of one of the types (1) to (6) or of the type (7). In the case of determining the quantity of reflected light, it is useful to calculate, e.g., an average value of the quantities of reflected light at the pixels, which are represented by image data captured by the CCD sensor or the CMOS sensor.

Next, according to a value (e.g., the above-described value of ($D_{max}$–$D_{min}$)) calculated by processing image data based on the image obtained from light reflected by the recording material, it can be determined whether the recording material is of one of the types (1) to (4), or of the type (5), or of the type (6) (i.e., the recording materials can be classified into three categories). In the present embodiment, for this determination, when the value of ($D_{max}$–$D_{min}$) is detected, shading processing is performed to eliminate a fluctuation component of the quantity of light emitted from the LED and to detect the fluctuation component. Then, the detected fluctuation component is subtracted from the light quantity (density) represented by the image data of the captured image. Consequently, unevenness of the light quantity is eliminated from the entire two-dimensional image captured by the sensor, so that the correct value of ($D_{max}$–$D_{min}$) can be obtained. In addition to the light quantity unevenness elimination processing, normalization processing can be performed to equalize the average values of the light quantities of the entire two-dimensional images.

Finally, an ultrasonic wave is irradiated from the ultrasonic transmitter 130 to the recording material 304. According to a signal received by the ultrasonic receiver 131, it can be determined which of the types (1), (2), (3), and (4) the type of the recording material is. The voltage values (I), (II), (III), and (IV) of the received signals respectively corresponding to the types (1), (2), (3), and (4) satisfy the following inequality:

$$(I)>(II)>(III)>(IV). \quad \text{i.}$$

Figure 16:
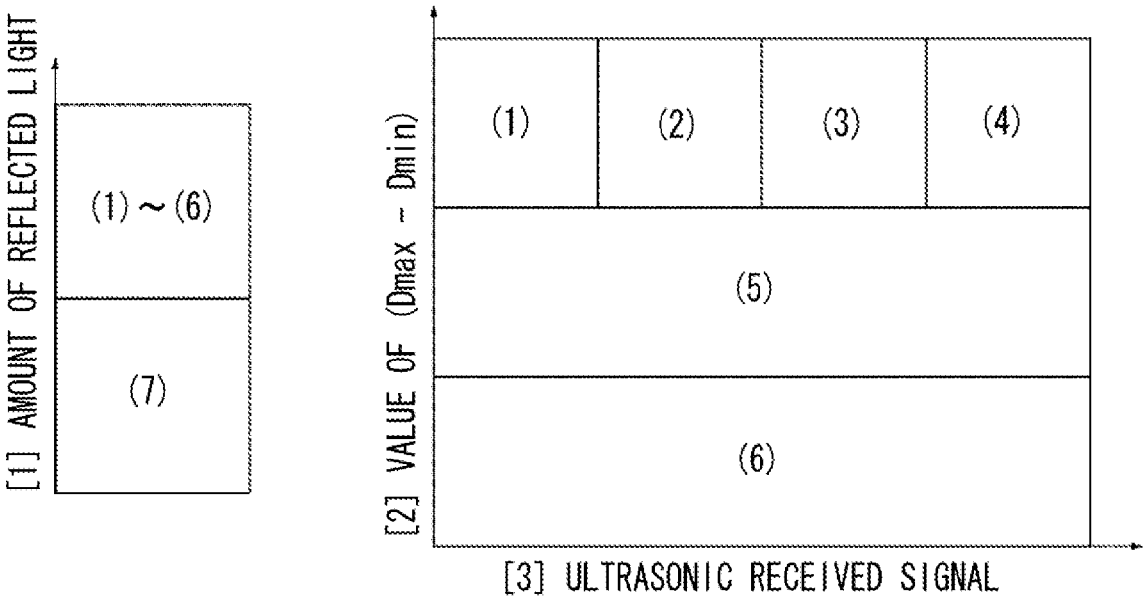
FIG. 16 illustrates a method of determining the type of a recording material using a reading sensor and an ultrasonic sensor according to an exemplary embodiment of the present invention.

FIG. 16 illustrate a combination of the above-described determinations.

First, a first determination operation [1] is performed according to the quantity of reflected light. More specifically, according to the quantity of reflected light, the recording material is classified into the group of the types (1) to (6) or the type (7). Then, a second determination operation [2] is performed according to the value of ($D_{max}$–$D_{min}$) calculated from the image data. More specifically, the recording material is classified into one of the three groups, i.e., the group of the types (1) to (4), the type (5), or the type (6) according to the value of ($D_{max}$–$D_{min}$). Finally, a third determination operation [3] is performed according to the received ultrasonic signal. More specifically, the recording material is classified into the type (1), the type (2), the type (3), or the type (4).

As illustrated in FIG. 16, the types (1) to (7) of the recording materials can be correctly determined using three parameters, i.e., the quantity of reflected light, the value of the density difference ($D_{max}$–$D_{max}$), and the received ultrasonic signal.

Figure 7:
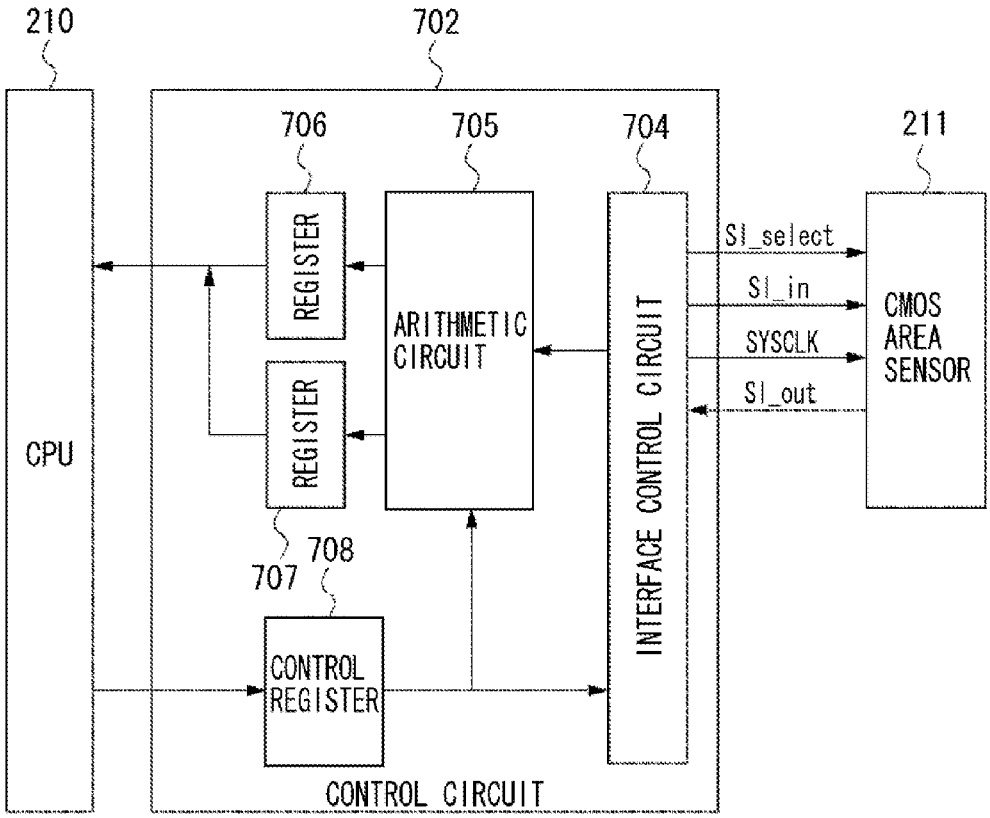
FIG. 7 illustrates a block diagram of a control circuit for controlling a CMOS area sensor.

An operation of controlling the CMOS area sensor 211 for performing the above-described determination operations is described with reference to FIG. 7. FIG. 7 illustrates a control circuit for controlling the CMOS area sensor 211. As illustrated in FIG. 7, the CPU 210 is connected to a control circuit 702. The control circuit 702 is connected to the CMOS area sensor 211. The control circuit 702 includes an interface control circuit 704, an arithmetic circuit 705, a register 706, a register 707, and a control register 708.

When the CPU 210 gives the control register 708 an instruction to operate the CMOS area sensor 211, capturing of an image of a surface of the recording material is started by the CMOS area sensor 211. That is, accumulation of electric charge in the CMOS area sensor 211 is started. According to a signal S1_select output from the interface control circuit 704, the CMOS area sensor 211 is selected. When a signal SYSCLK is generated at a predetermined timing, digital image data representing a captured image, which is represented by a signal S1_out, is sent from the CMOS area sensor 211 in response to a signal S1_in.

The arithmetic circuit 705 receives captured image data via the interface circuit 704. Then, the arithmetic circuit 705 performs an analog-to-digital (A/D) conversion on the received image data. A result of the conversion is stored in the register 706 and the register 707. The CPU 210 determines the attribute of the recording material according to the values of the two registers 706 and 707.

Figure 8:
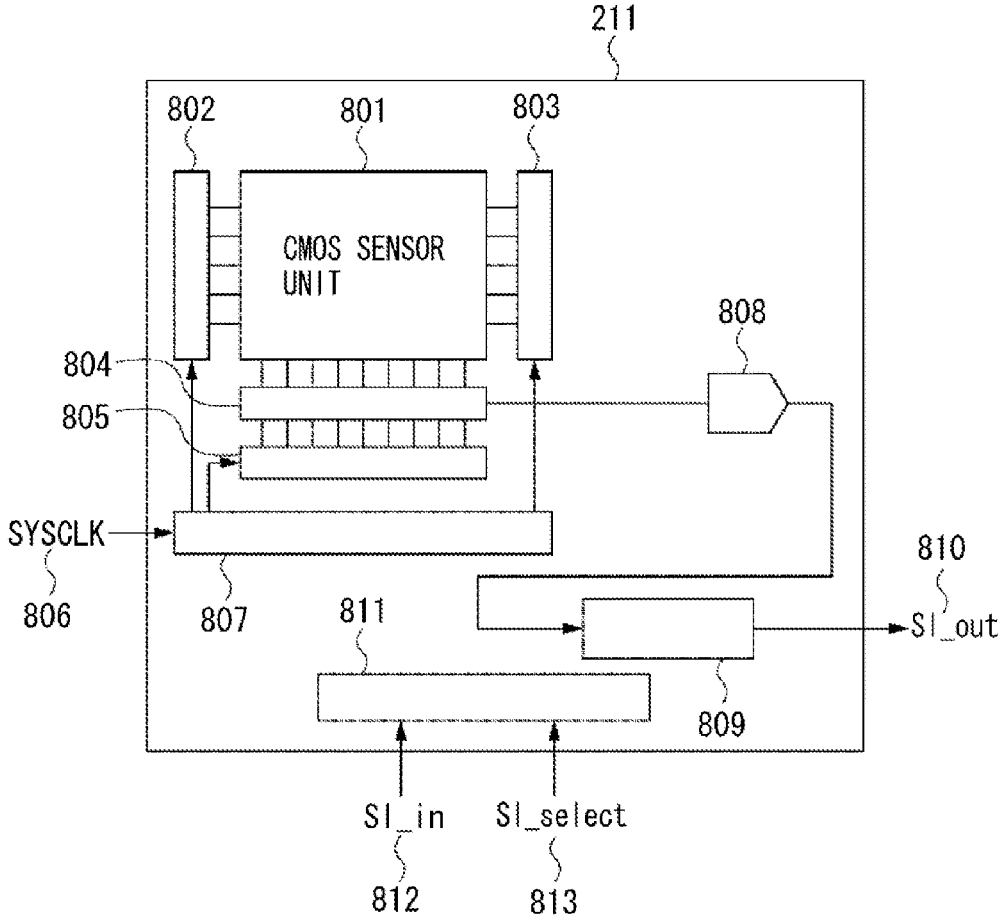
FIG. 8 illustrates a block diagram of a circuit of the CMOS area sensor.

Next, the CMOS area sensor 211 is described with reference to FIG. 8. FIG. 8 is a block diagram illustrating the CMOS area sensor 211. As illustrated in FIG. 8, the CMOS area sensor 211 includes a CMOS sensor unit 801, in which sensors of 8×8 pixels are arranged like an area array. The CMOS area sensor 211 further includes vertical shift registers 802 and 803, an output buffer 804, a horizontal shift register 805, a system clock 806, and a timing generator 807.

When a signal S1_select 813 is activated, the CMOS sensor unit 801 starts accumulating electric charge based on the received light. Next, when a system clock 806 is given to the CMOS area sensor 211, lines of pixels to be read to the vertical shift registers 802 and 803 are sequentially selected by the timing generator 807. Thus, data is sequentially stored in the output buffer 804.

The data stored in the output buffer 804 is transferred by the horizontal shift register 805 to an A/D converter (analog-to-digital converter) 808. The transferred pixel data is converted by the A/D converter 808 into digital pixel data. Then, the digital pixel data is controlled by an output interface circuit 809 at a predetermined timing. Thus, during a period in which the signal S1_select 813 is active, the digital pixel data is output as a signal S1_out 810.

A control circuit 811 can perform a control operation of changing the gain of the A/D conversion in response to a signal S1_in 812. For example, in a case where the contrast of the captured image is insufficient, the CPU 210 changes the gain of the A/D conversion, so that the best contrast image can always be captured.

Next, an operation of the ultrasonic sensor is described in detail below.

Figure 9:
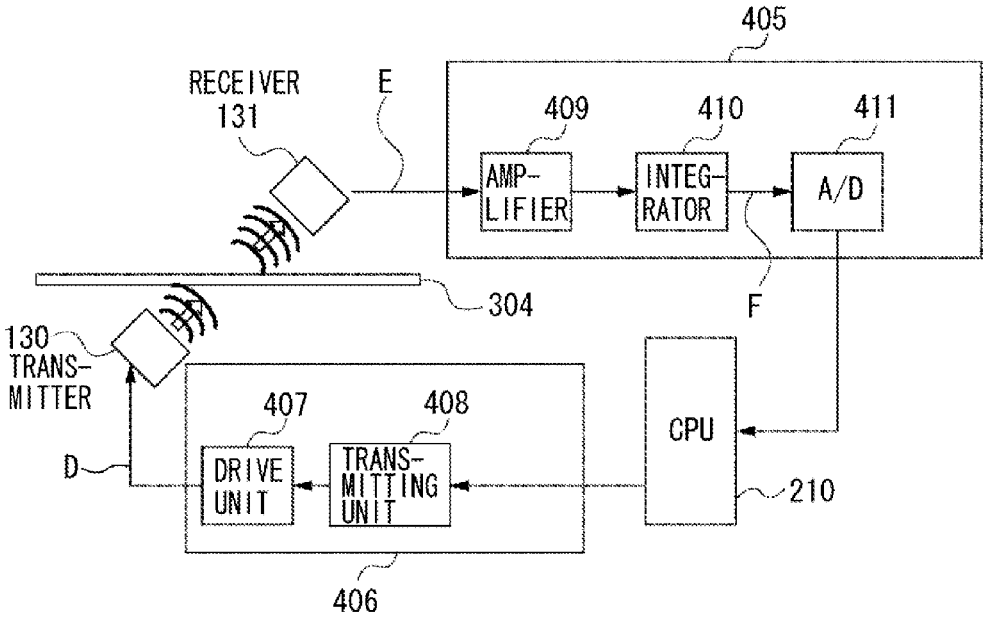
FIG. 9 illustrates a block diagram of a control circuit according to a determination method using an ultrasonic sensor.
Figure 10:
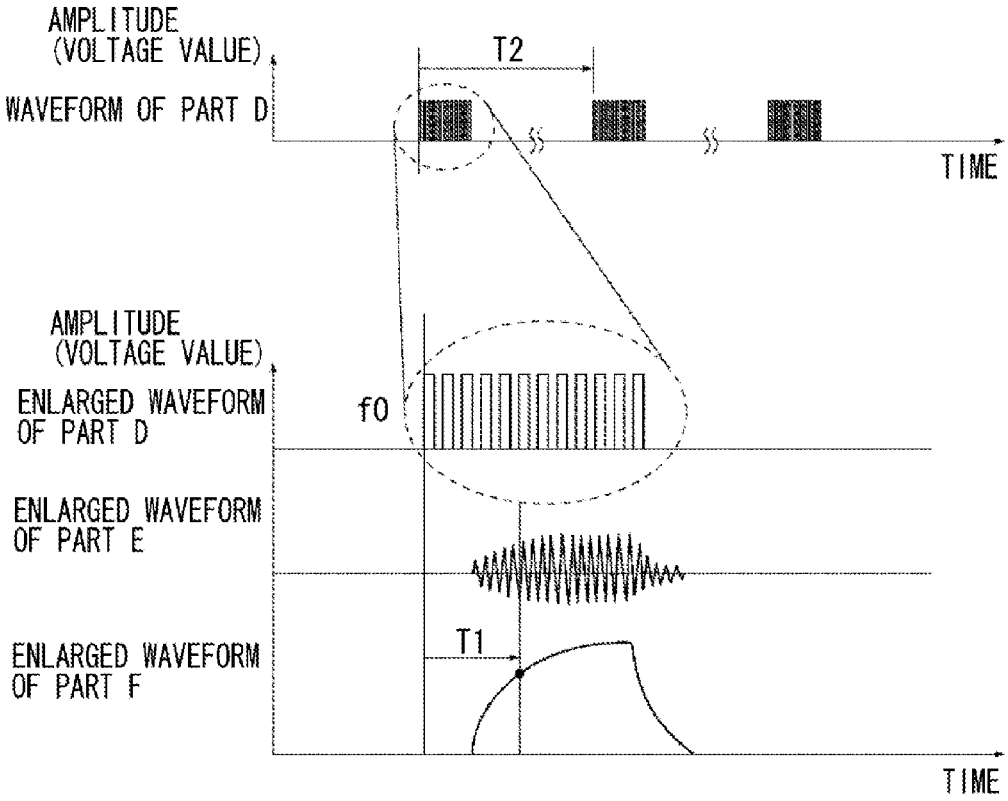
FIG. 10 illustrates a waveform of a signal flowing through each part of the control circuit according to the determination method using an ultrasonic sensor in an operation of the control circuit.

FIG. 9 illustrates a control circuit according to a determination method using the ultrasonic sensor. FIG. 10 illustrates a waveform of a signal flowing through each part of the control circuit illustrated in FIG. 9 according to the determination method using the ultrasonic sensor in an operation of the control circuit.

The ultrasonic transmitter 130 and the ultrasonic receiver 131 are located opposite each other across the recording material 304. An ultrasonic wave output from the ultrasonic transmitter 130 is irradiated obliquely to the recording material 304 at a predetermined angle.

The CPU 210 controls other units to feed the recording material 304 from the cassette 102 (see FIG. 1). When the recording material 304 reaches a position between the ultrasonic transmitter 130 and the ultrasonic receiver 131, the CPU 210 issues a transmission start signal to a transmitting unit 408 in a transmitting circuit 406. When receiving the transmission start signal, the transmitting unit 408 generates several rectangular waves of a predetermined frequency f0 (=40 kHz in the case of the present embodiment) at predetermined intervals T2. A drive unit 407 uses a transmission signal generated by the transmitting unit 408 and drives the ultrasonic transmitter 130 with a part D thereof having a waveform illustrated in FIG. 10. Although the predetermined frequency f0 is 40 kHz in the present embodiment, the frequency can appropriately be changed according to the arrangement configuration of the receiver 131 and the transmitter 130 and to the distance therebetween.

An ultrasonic wave is irradiated from the ultrasonic transmitter 130 to the recording material 304. An ultrasonic wave from the recording material 304 is received by the ultrasonic receiver 131. The received signal has a waveform of a part E illustrated in FIG. 10. The received signal is amplified by an amplifier 409. Then, the amplified signal is integrated by an integrator 410 to have a waveform of a part F illustrated in FIG. 10.

The CPU 210 takes in data from the integrator 410 via the A/D converter 411 after the lapse of a predetermined time T1 since the timing at which the transmission signal is sent to the transmitting unit 408. FIG. 6 illustrates the relationship between the data output from the integrator 410 and the grammage.

Thus, many types of the recording materials can be determined using the reading sensor 123, and the ultrasonic transmitter 130 and the ultrasonic receiver 131, which serve as an ultrasonic sensor. The arrangement positions of the ultrasonic transmitter 130 and the ultrasonic receiver 131, which serve as an ultrasonic sensor, the conveyance roller 150, and the reading sensor 123 are described below with reference to FIGS. 11 and 12.

Figure 11:
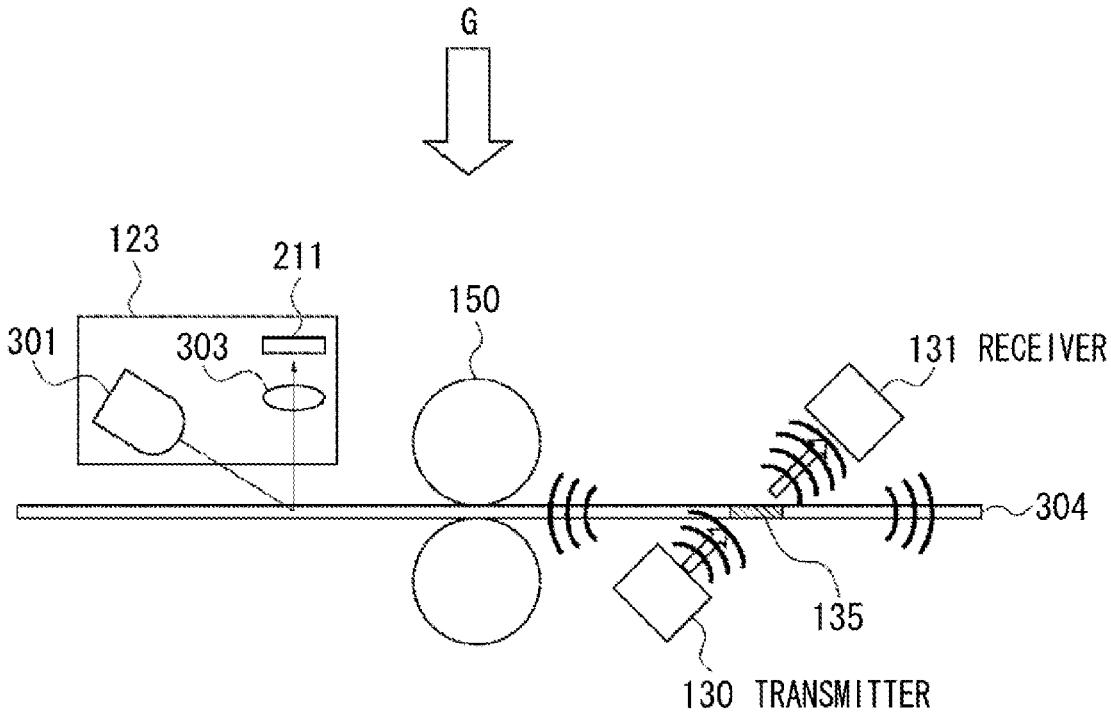
FIG. 11 illustrates a detection state using a reading sensor and an ultrasonic sensor according to a first exemplary embodiment of the present invention.
Figure 12:
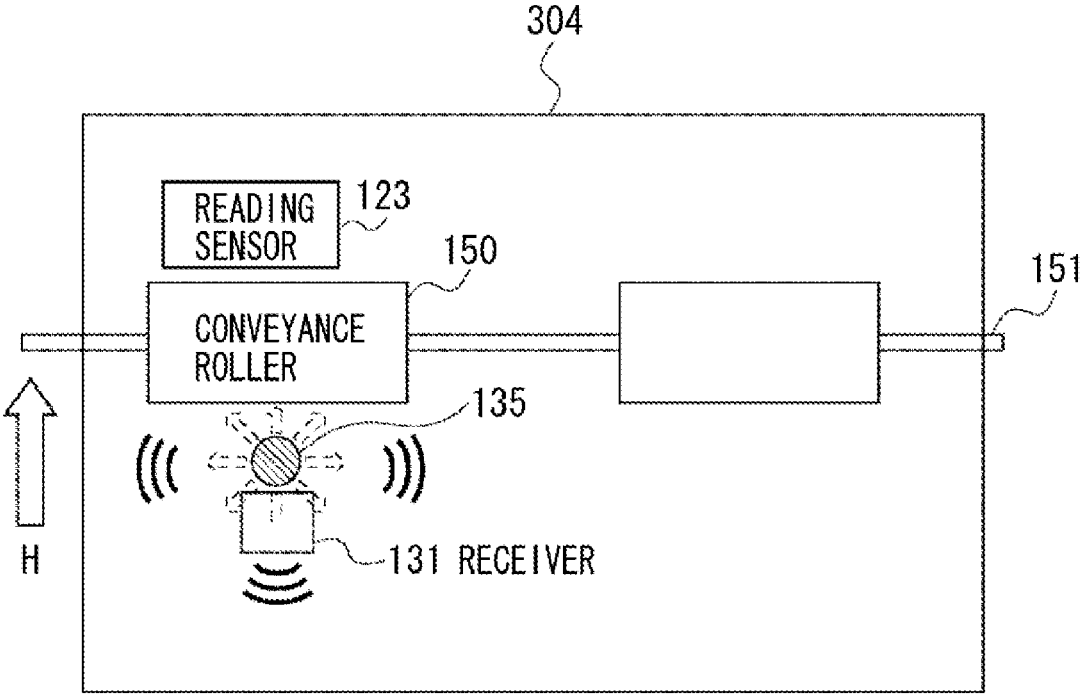
FIG. 12 illustrates arrangement positions of the reading sensor and the ultrasonic sensor according to the first exemplary embodiment of the present invention.

As illustrated in FIGS. 11 and 12, the ultrasonic transmitter 130 and the ultrasonic receiver 131 are located at the upstream side in a direction of conveying the recording material 304 from the conveyance roller 150. The reading sensor 123 is located at the downstream side in the direction of conveying the recording material 304 from the conveyance roller 150. More specifically, the reading sensor 123 is located at a position that faces a surface of the recording material 304 to be conveyed and is in the vicinity of the conveyance roller 150, as illustrated FIG. 11 or 12. The ultrasonic transmitter 130 and the ultrasonic receiver 131 are located opposite each other across the recording material 304. The conveyance roller 150 is a roller pair member, which contacts the recording material 304 and conveys the recording material 304 while nipping the recording material 304. That is, the ultrasonic sensor (including the ultrasonic transmitter 130 and the ultrasonic receiver 131) and the reading sensor 123 are located opposite each other with respect to a contact portion of the conveyance roller 150, which contacts the recording material 304.

FIG. 12 is a view taken from a direction G shown in FIG. 11.

As illustrated in FIG. 12, an ultrasonic wave irradiated from the ultrasonic transmitter 130 impinges upon a position 135 of the recording material 304. A position, at which an ultrasonic wave is irradiated onto the recording material 304, is the position 135 having a predetermined area. The recording material 304 is vibrated by the ultrasonic wave irradiated onto the position 135. The vibrations of the recording material 304 propagate peripherally from the irradiating position 135, at which the ultrasonic wave is irradiated to the recording material 304, as indicated by dashed arrows shown in FIG. 12.

The conveyance roller 150, nipping the recording material 304, is located between the reading sensor 123 and each of the ultrasonic transmitter 130, the ultrasonic receiver 131, and the irradiating position 135. Accordingly, vibrations in a direction H propagating in the recording material 304 (i.e., vibrations propagating towards the reading sensor 123) are blocked by the conveyance roller 150. Thus, in an area imaged by the reading sensor 123, an image of a surface of the recording material 304 can be captured substantially without being affected by the vibrations.

For the sake of explanation, suppose that the conveyance roller 150 is absent between the reading sensor 123 and each of the ultrasonic transmitter 130 and the ultrasonic receiver 131, which serve as the ultrasonic sensor, differently from the case illustrated in FIGS. 11 and 12, in which the conveyance roller 150 is located therebetween. In such a case, the recording material is vibrated by irradiating an ultrasonic wave thereto. Thus, it is highly likely that an image read by the reading sensor 123 is affected by the vibrations and becomes incorrect. For example, it is sufficient that a detection operation of the reading sensor 123 and a detection operation by the ultrasonic sensor are performed independent of each other. However, according to this method, the detection operations take time. Therefore, in order to reduce a detection time, it is desirable that a detection operation using the reading sensor and that using the ultrasonic sensor are simultaneously performed.

With the configurations according to the present embodiment, which are illustrated in FIGS. 11 and 12, even in a case where the reading sensor and the ultrasonic sensor perform detection operations at the same timing, the attribute of the recording material can be detected without troubles.

It has been described that according to the present embodiment, the reading sensor 123 is located at the downstream side in the direction of conveying the recording material with respect to the conveyance roller 150, while the ultrasonic transmitter 130 and the ultrasonic receiver 131 serving as the ultrasonic sensor are located at the upstream side.

However, conversely, the apparatus can be configured so that the reading sensor 123 is located at the upstream side in the direction of conveying the recording material with respect to the conveyance roller 150, while the ultrasonic transmitter 130 and the ultrasonic receiver 131 are located at the downstream side.

Figure 13:
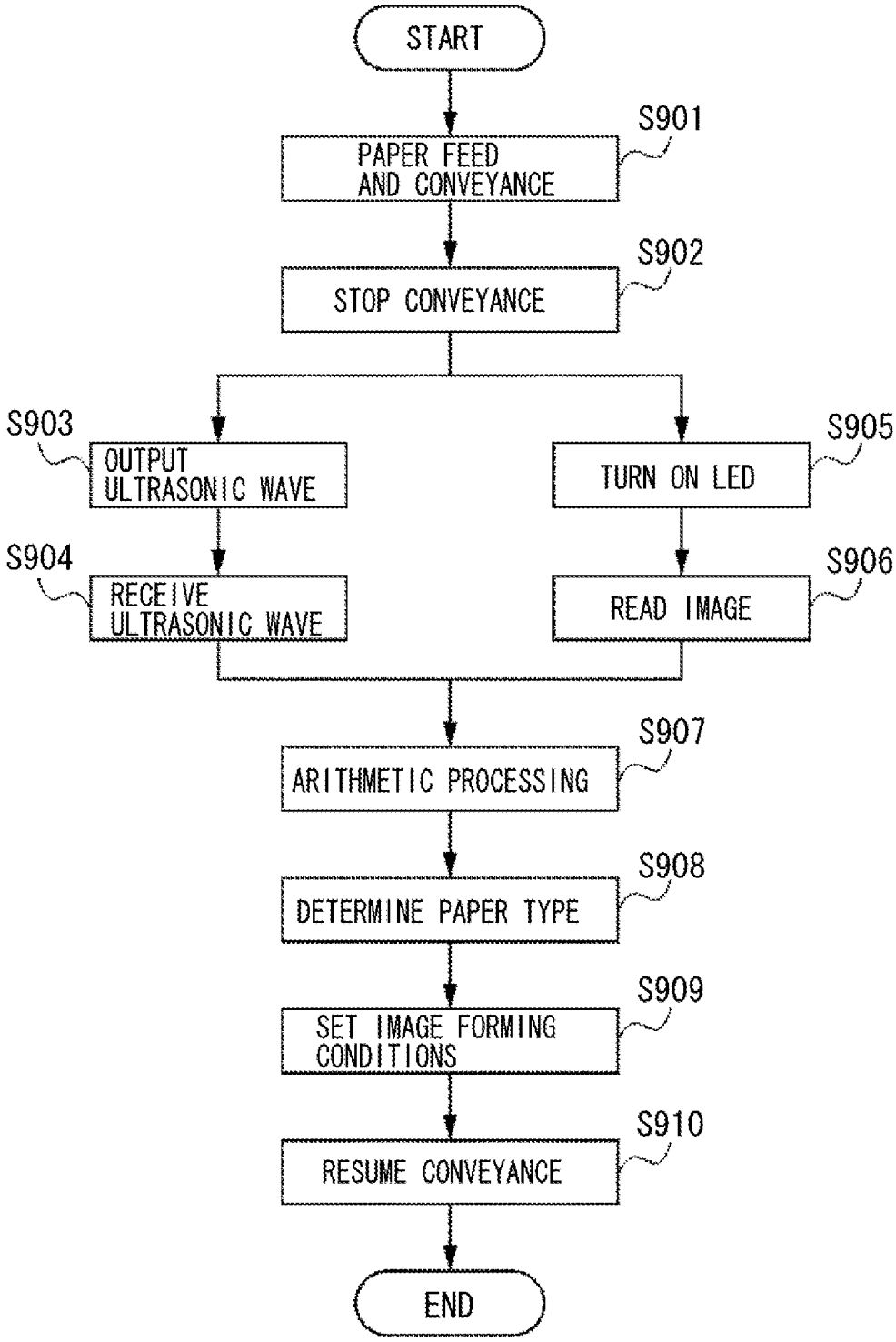
FIG. 13 illustrates a flowchart of a detection operation according to the first exemplary embodiment of the present invention.

Next, the timing of a detection operation is described below with reference to a flowchart illustrated in FIG. 13.

When the detection operation is started, instep S901, the CPU 210 controls other units so as to feed a recording material 304 from the cassette 102 (FIG. 1) using the roller 103 (FIG. 1). The recording material 304 fed therefrom is conveyed by the conveyance roller 150 to a position at which the ultrasonic transmitter 130 and the ultrasonic receiver 131 are located. Then, in step S902, the CPU 210 stops the conveyance of the recording material 304 by stopping the rotation of the conveyance roller 150 at a time at which the recording material 304 is expected to reach the reading sensor 123 and at which a predetermined time period has elapsed since a paper feed timing.

In step S903, the CPU 210 causes the ultrasonic transmitter 130 to output and irradiate an ultrasonic wave to the recording material 304. In step S904, the CPU 210 causes the ultrasonic receiver 131 to receive an ultrasonic wave from the recording material 304.

Substantially simultaneously with this timing, instep S905, the CPU 210 turns on the LED 301 and causes the LED 301 to irradiate light to a surface of the recording material 304. Then, light reflected from the recording material 304 is focused via the lens 303 and is formed into an image on the CMOS area sensor 211. Consequently, in step S906, an image of the surface of the recording material 304 is read.

In step S907, the CPU 210 performs arithmetic processing (the above-described calculation processing) on a signal received from the ultrasonic receiver 131 and on image data read by the reading sensor 123. In step S908, the CPU 210 determines the type of paper (recording material) according to results of this processing.

In step S909, the CPU 210 sets image processing conditions (e.g., conditions for setting the temperature of the fixing device, the speed of conveying the recording material, and the developing voltage and the transfer voltage, which are output from the high-voltage power supply 219) according to the determined type of paper.

In step S910, the CPU 210 resumes the rotation of the conveyance roller 150 to convey the recording material 304. Thus, the detection operation is finished.

As described above, with the arrangement configuration of the present embodiment illustrated in FIGS. 11 and 12, even when the detection operation of the reading sensor and that of the ultrasonic sensor are performed substantially at the same timing, the detection operation of the reading sensor can be performed substantially without being affected by the vibrations of the recording material, which are caused by the detection operation of the ultrasonic sensor.

Accordingly, the type of the recording material can be determined correctly. Consequently, an image can be formed by setting appropriate image forming conditions according to the determined type of the recording material.

Alternatively, the setting of the image forming conditions can be performed according to the result of the detection using the reading sensor and that of the detection using the ultrasonic sensor. Consequently, the operation of determining the type of the recording material according to the result of the detection can be omitted.

Second Exemplary Embodiment

A configuration of components of a second exemplary embodiment other than the arrangement of the reading sensor 123, the ultrasonic transmitter 130 and the ultrasonic receiver 131, which serve as a ultrasonic sensor, the conveyance roller 150, and the recording material 304 is similar to that of components of the first exemplary embodiment. Therefore, the detailed description of such components of the second exemplary embodiment is omitted.

In the first exemplary embodiment, the reading sensor 123 is located opposite the ultrasonic sensor across the conveyance roller 150 in the direction of conveying the recording material 304.

Figure 14:
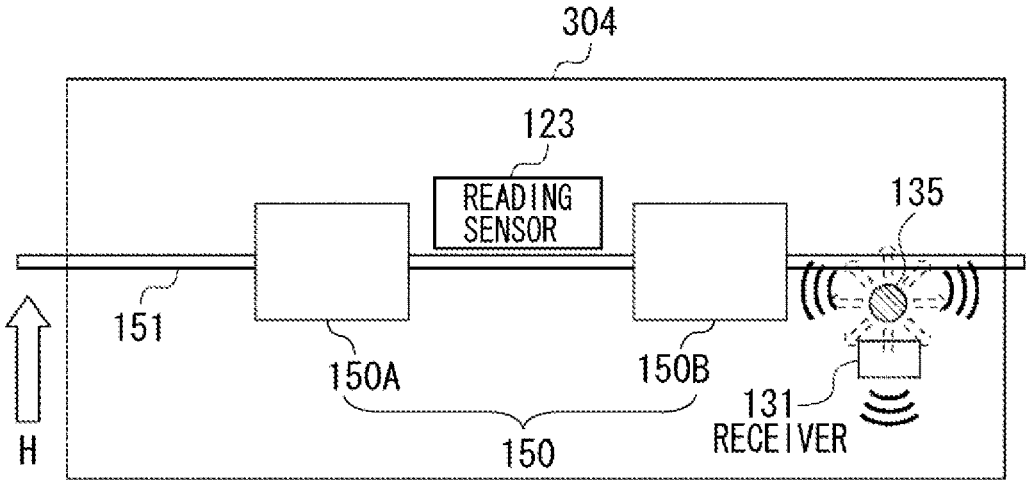
FIG. 14 illustrates a detection state using a reading sensor and an ultrasonic sensor according to a second exemplary embodiment of the present invention.

In the second exemplary embodiment, the conveyance roller 150 is configured to include a plurality of conveyance members 150A and 150B provided on a shaft 151, as illustrated in FIG. 14. The reading sensor 123 is located between the conveyance members 150A and 150B. That is, as illustrated in FIG. 14, the reading sensor 123 detects substantially a central part of the recording material 304. The ultrasonic transmitter 130 and the ultrasonic receiver 131, which serve as the ultrasonic sensor, are located at an end of the recording material 304, which is opposite the arrangement position of the reading sensor 123, across the conveyance member 150B (particularly, a contact portion between the recording material 304 and the conveyance member 150B) of the conveyance roller 150.

Alternatively, the reading sensor 123 can be located at the end of the recording material 304 across the conveyance member 150B of the conveyance roller 150. In addition, the ultrasonic transmitter 130 and the ultrasonic receiver 131, which serve as the ultrasonic sensor, can be located substantially at the central position between the conveyance members 150A and 150B of the conveyance roller 150. It is sufficient that the reading sensor and the ultrasonic sensor are located opposite each other across the conveyance member 150A or 150B of the conveyance roller 150.

In the second exemplary embodiment, the reading sensor 123 is located at the downstream side of the shaft 151 of the conveyance roller 150 in the direction of conveying the recording material 304. The ultrasonic transmitter 130 and the ultrasonic receiver 131 are located at the upstream side of the shaft 151.

However, the reading sensor 123 can be located at the upstream side of the shaft 151 of the conveyance roller 150 in the direction of conveying the recording material 304. In addition, the ultrasonic transmitter 130 and the ultrasonic receiver 131 can be located at the downstream side of the shaft 151.

Similar to the first exemplary embodiment, an ultrasonic wave irradiated from the ultrasonic transmitter 130 impinges upon the position 135 on the recording material 304. Vibrations propagate peripherally from the irradiating position 135 on the recording material 304.

The conveyance roller 150, nipping the recording material 304, is located between the reading sensor 123 and each of the ultrasonic transmitter 130, the ultrasonic receiver 131, and the irradiating position 135. Accordingly, vibrations propagating in the direction H in the recording material 304 are blocked by the conveyance roller 150. Thus, in an area imaged by the reading sensor 123, an image of a surface of the recording material 304 can be captured substantially without being affected by the vibrations.

Accordingly, the type of the recording material can correctly be determined in a short time. Consequently, image formation can be performed by appropriately setting the image forming conditions according to the type of the recording material.

Third Exemplary Embodiment

A configuration of components of a third exemplary embodiment other than the provision of a recording material detection unit therein is similar to those of components of the first and second exemplary embodiments. Therefore, the detailed description of components of the third exemplary embodiment, which are common to the first, second, and third exemplary embodiments, is omitted.

In the first and second exemplary embodiments, the CPU 210 stops the conveyance of the recording material 304 by stopping the rotation of the conveyance roller 150 at a time at which the recording material 304 is expected to reach the reading sensor 123 and at which a predetermined time period has elapsed since a paper feed timing.

Figure 15:
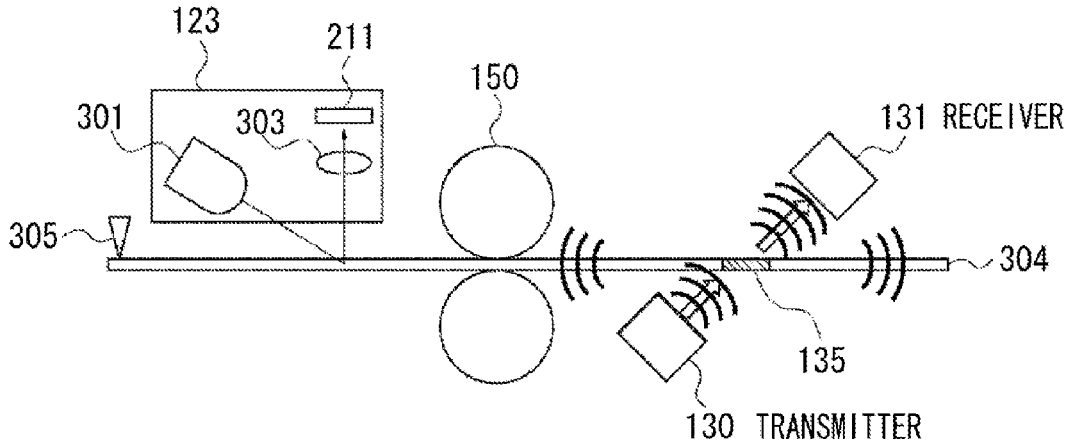
FIG. 15 illustrates a detection state using a reading sensor and an ultrasonic sensor according to a third exemplary embodiment of the present invention.

On the other hand, in the third exemplary embodiment, a recording material detection unit 305 is added to a position at the downstream side of the conveyance roller 150 in the direction of conveying the recording material 304, as illustrated in FIG. 15. For example, a system configured to irradiate light from a light irradiating unit, such as an LED, to the recording material and to detect light reflected from the recording material by an optical detection unit such as a phototransistor, can be used as the recording material detection unit 305. Alternatively, a sensor including a flag, which operates when the recording material passes therethrough, and a photo-interrupter, which detects an operation of the flag, can be used as the recording material detection unit 305.

When the recording material detection unit 305 detects a leading edge of the recording material 304, the CPU 210 stops the rotation of the conveyance roller 150, at the timing at which the leading edge is detected, to stop the conveyance of the recording material 304.

Subsequently, in a state in which the CPU 210 causes the ultrasonic transmitter 130 to output and irradiate an ultrasonic wave to the recording material 304. Then, the CPU 210 causes the ultrasonic receiver 131 to receive an ultrasonic wave from the recording material 304 and to determine the grammage of the recording material 304 (the details of this processing has been described above, and thus the description thereof is omitted).

Simultaneously, the CPU 210 turns on the LED 301 to irradiate light to a surface of the recording material 304. Light reflected from the recording material 304 is focused via the lens 303 and is formed into an image on the CMOS area sensor 211. Consequently, an image of the surface of the recording material 304 is read. The surface condition of the recording material 304 is then determined according to a result of processing image data obtained by performing digital processing on the read image (the details of this processing has been described above, and thus the description thereof is omitted).

Upon completion of both the determination of the type of the recording material 304 based on result of the determination using the reading sensor and that of the type of the recording material 304 based on result of the determination using the ultrasonic wave sensor, the CPU 210 determines the type of the recording material 304 and causes the conveyance roller 150 to rotate to convey the recording material 304. Then, the above-described image forming conditions are set. Thus, an image is formed on the recording material 304.

As described above, a position, at which the recording material 304 is stopped, is accurately determined by the recording material detection unit 305. Consequently, detection positions, at each of which the recording material is detected, can be substantially the same position. Accordingly, variation in the surface condition of the recording material 304 and in the grammage thereof due to the difference in the position on the recording material 304 (e.g., a difference in the surface condition between a leading ege portion and a central portion of the recording material) can be reduced. Consequently, detection accuracy can be enhanced.

Fourth Exemplary Embodiments

A configuration of components of a fourth exemplary embodiment other than a detection timing for determining the type of a recording material is similar to those of components of the first and second exemplary embodiments. Therefore, the detailed description of components of the fourth exemplary embodiment, which are common to the first, second, and fourth exemplary embodiments, is omitted.

Figure 17:
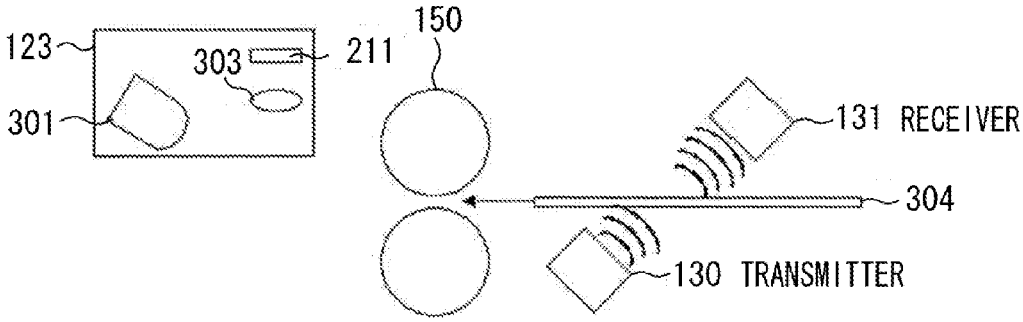
FIG. 17 illustrates detection timing by an ultrasonic sensor according to a fourth exemplary embodiment of the present invention.
Figure 18:
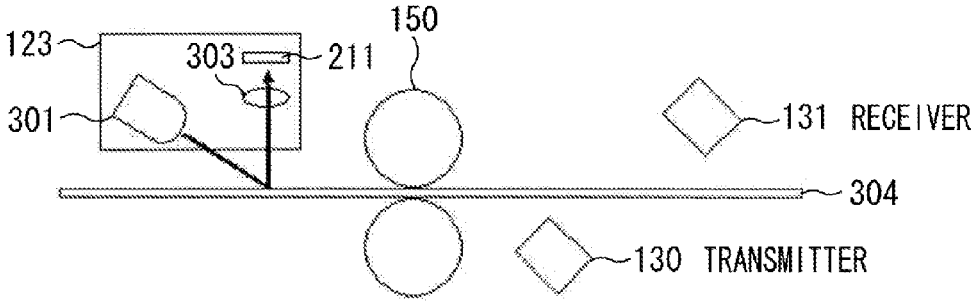
FIG. 18 illustrates detection timing by a reading sensor according to the fourth exemplary embodiment of the present invention.

A detection timing according to the third exemplary embodiment is described below with reference to FIGS. 17 and 18. FIG. 17 illustrates a state in which the thickness and the grammage of the recording material 304 are detected using the ultrasonic transmitter 130 and the ultrasonic receiver 131. FIG. 18 illustrates a state in which the surface condition of the recording material 304 is detected by the reading sensor 123.

As illustrated in FIGS. 17 and 18, the ultrasonic transmitter 130 and the ultrasonic receiver 131 are located at the upstream side of the conveyance roller 150 in the direction of conveying the recording material 304. The reading sensor 123 is located at the downstream side of the conveyance roller 150.

As illustrated in FIG. 17, the thickness and the grammage of the recording material 304 are detected using the ultrasonic transmitter 130 and the ultrasonic receiver 131 before the recording material 304 reaches the conveyance roller 150. At that time, a recording material determination apparatus according to the present embodiment is in process of conveying the recording material 304. The detection of the grammage using an ultrasonic wave is finished before the recording material 304 reaches the conveyance roller 150.

Next, as illustrated in FIG. 18, the recording material 304 stops at a moment at which the recording material 304 reaches the reading sensor 123 after the recording material 304 has reached the conveyance roller 150. In this stopped state, the reading sensor 123 detects the surface condition and the reflectivity of the recording material 304.

Figure 19:
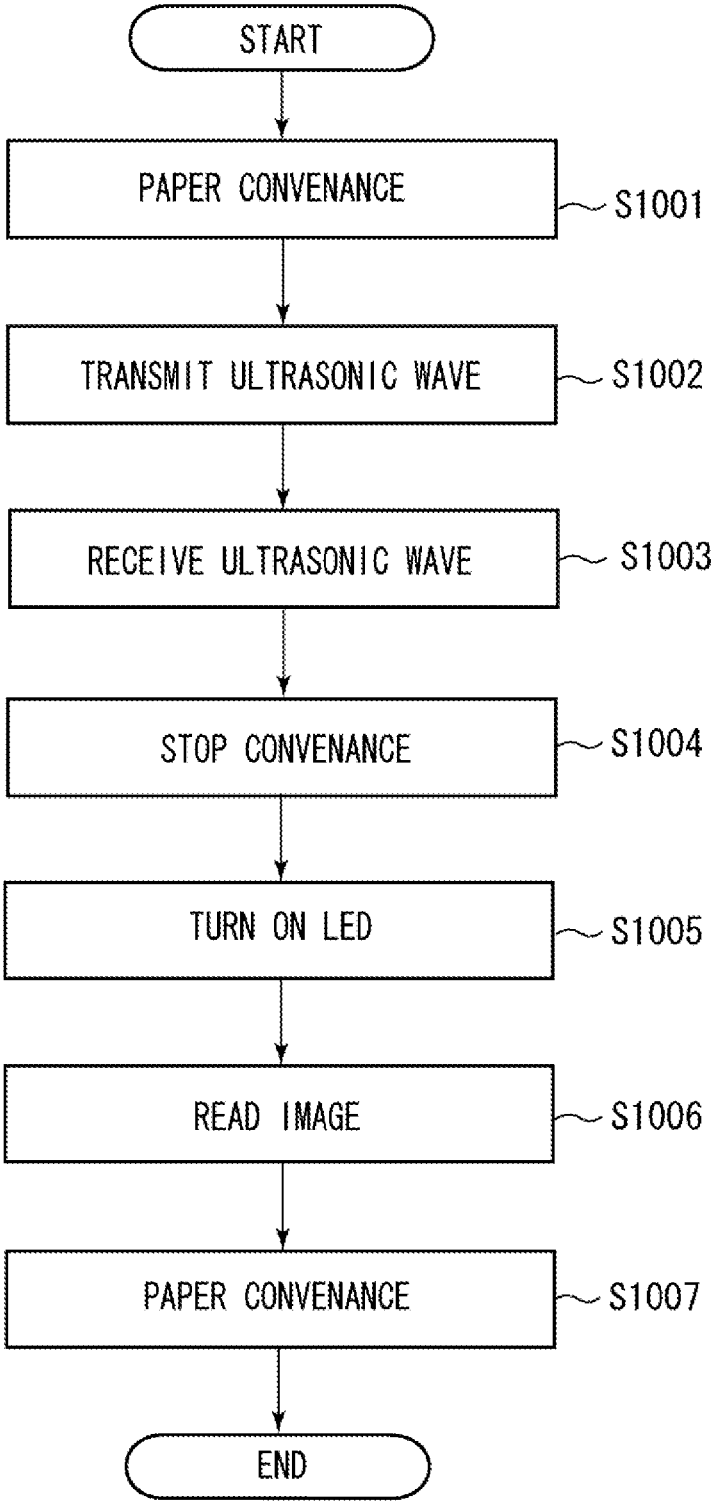
FIG. 19 illustrates a flowchart of a detection operation according to the fourth exemplary embodiment of the present invention.

Next, a sequence of steps of a detection operation is described below with reference to a flowchart illustrated in FIG. 19.

When the detection operation is started, the CPU 210 controls other units so as to feed a recording material 304 from the paper feed cassette 102 using the paper feed roller 103 and to convey the recording material 304. In step S, the conveyed recording material 304 is further conveyed to a position between the ultrasonic transmitter 130 and the ultrasonic receiver 131 via the conveyance roller 150. Then, in step S, the CPU 210 controls the ultrasonic transmitter 130 to irradiate an ultrasonic wave onto the recording material 304 at a time at which the recording material 304 is expected to reach the position between the ultrasonic transmitter 130 and the ultrasonic receiver 131 and at which a predetermined time period has elapsed since a paper feed timing at which the recording material 304 has been fed. In step S, the ultrasonic receiver 131 receives an ultrasonic wave from the recording material 304. The CPU 210 stops the detection of the thickness and the grammage of the recording material 304 before the recording material 304 reaches the conveyance roller 150.

Then, in step S, the CPU 210 stops the conveyance of the recording material 304 by stopping the rotation of the conveyance roller 150 at the time at which the recording material 304 is expected to reach the reading sensor 123 and at which a predetermined time period has elapsed since a paper feed timing at which the recording material 304 has been fed. In step S, the CPU 210 turns on the LED 301 and controls the LED 301 to irradiate light onto a surface of the recording material 304. Light reflected from the recording material 304 is focused via the lens 303 and is formed into an image on the CMOS are sensor 211. Consequently, in step S, an image of the surface of the recording material 304 is read. The CPU 210 detects the surface condition of the recording material 304 according to the read image. In step S, the CPU 210 causes the conveyance roller 150 to rotate after the image of the surface of the recording material 304 is captured, to convey the recording material 304. Then, the CPU 210 finishes the detection operation.

As described above, according to the present embodiment, first, the grammage of the recording material is detected by irradiating an ultrasonic wave onto the recording material during the conveyance of the recording material. Subsequently, the recording material is stopped. Then, the surface condition of the recording material is detected. Consequently, the recording material determination apparatus is resistant to vibrations of the recording material, which are caused by an ultrasonic wave, when the image is read to detect the surface condition of the recording material. Accordingly, the recording material determination apparatus can correctly determine the type of the recording material. Thus, image formation can be performed by appropriately setting image forming conditions according to the determined type of the recording material.

According to the present embodiment, the detection operation using the ultrasonic sensor and the detection operation using the reading sensor are performed at different timings. Therefore, as compared with the first exemplary embodiment, a detection time is increased according to the fourth exemplary embodiment. However, because the detection operation using the ultrasonic sensor is performed while the recording material is being conveyed, an increase in the detection time taken by the detection operation using the ultrasonic sensor can be reduced.

Figure 20:
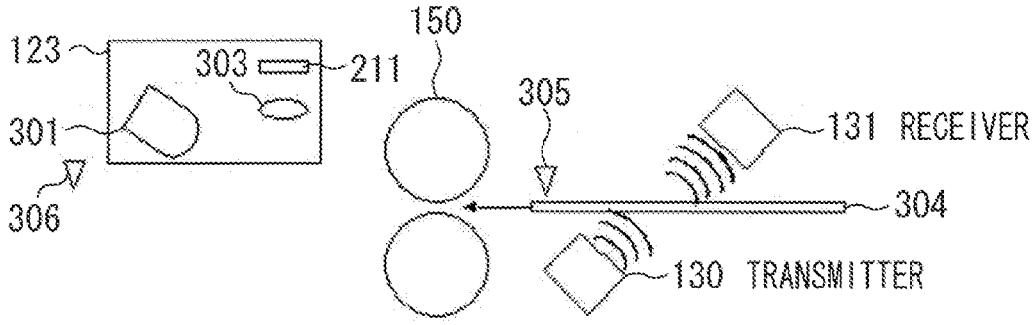
FIG. 20 illustrates a modification of the fourth exemplary embodiment of the present invention.
Figure 21:
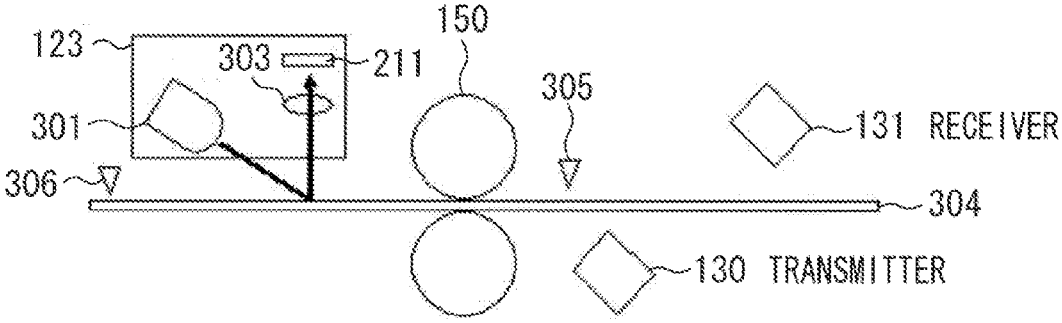
FIG. 21 illustrates detection timing by a reading sensor according to the modification of the fourth exemplary embodiment of the present invention.

When a detection operation according to the present embodiment is performed, a conveyance operation can be controlled by detecting a leading edge of the recording material using the recording material detection unit described in the third embodiment. More specifically, a detection operation using the reading sensor can be performed by stopping the conveyance operation of conveying the recording material in response to the detection of a leading edge of the recording material using the recording material detection unit. The recording material detection unit can be located at the upstream side (the upstream side in the direction of conveying the recording material). In this case, a detection operation using the ultrasonic sensor can be started at a timing at which a leading edge of the recording material is detected by the recording material detection unit. FIGS. 20 and 21 illustrate an example of a modification of the present embodiment, which is provided with two recording material detection units. This modification is provided with recording material detection units 305 and 306. When a leading edge of the recording material is detected by the recording material detection unit 305, a detection operation using the ultrasonic sensor is performed. Subsequently, when the leading edge of the recording material is detected by the recording material detection unit 306, a detection operation using the reading sensor can be performed. A configuration of this modification is similar to those of the first and second exemplary embodiments except that two recording material detection units are provided in the apparatus.

Other Exemplary Embodiments

The present embodiment is similar to the first exemplary embodiment except that the reading sensor is changed to a reflection type optical sensor.

In the first to third exemplary embodiments, the surface condition of the recording material 304 is detected using the CMOS area sensor or the CCD sensor.

In the present embodiment, a sensor including a light emitting element and two light receiving elements is used instead of the CMOS area sensor or the CCD sensor.

More specifically, in the present embodiment, the reflection type optical sensor includes a light emitting element, a first light receiving element configured to receive diffused light included in light reflected by the recording material, and a second light receiving element configured to receive specular reflection light and located at an angle differing from that at which the first light receiving element is located.

The surface condition of the recording material can be determined using such a reflection type optical sensor according to a result of calculating a ratio of a light quantity detected by the first light receiving element to a light quantity detected by the second light receiving element.

A configuration and operation of the reflection type optical sensor are publicly known. Thus, the description of the configuration and operation of the reflection type optical sensor is omitted.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A recording material determination apparatus configured to determine a type of a recording material, the recording material determination apparatus comprising:

a first detection unit configured to irradiate the recording material with light and detect the light via the recording material;

a second detection unit configured to irradiate the recording material with an ultrasonic wave and detect the ultrasonic wave via the recording material, wherein vibrations of the recording material being detected by the second detection unit with the ultrasonic wave are suppressed by a contact unit in contact with the recording material, and the first detection unit and the second detection unit are located at a downstream side of a feeding unit configured to feed the recording material stacked on a stacking unit in a direction of conveying the recording material, and wherein the recording material is at a position where the second detection unit detects the recording material when the recording material is at a position where the first detection unit detects the recording material.

2. The recording material determination apparatus according to claim 1, wherein the first detection unit and the second detection unit are located opposite each other with respect to the contact unit.

3. The recording material determination apparatus according to claim 1, wherein the first detection unit and the second detection unit perform respective detection operations in a state in which the recording material is stopped.

4. The recording material determination apparatus according to claim 1, wherein the first detection unit includes an image reading sensor configured to irradiate light to a surface of the recording material, to capture light reflected from the surface of the recording material as an image, and to detect a surface condition of the recording material based on the captured image, and wherein the first detection unit and the second detection unit perform respective detection operations substantially at the same timing.

5. The recording material determination apparatus according to claim 4, wherein the first detection unit detects a quantity of light reflected from the recording material and image data representing the captured image of the surface of the recording material, and the second detection unit detects the ultrasonic wave passing through the recording material.

6. The recording material determination apparatus according to claim 1, wherein the second detection unit starts a detection operation earlier than the first detection unit does.

7. The recording material determination apparatus according to claim 1, further comprising:

a third detection unit configured to detect that a recording material is conveyed to a position where the first detection unit and the second detection unit are capable of detecting a recording material, wherein the first detection unit and the second detection unit detect the recording material based on a detection result of the third detection unit.

8. The recording material determination apparatus according to claim 1, wherein the first detection unit, the second detection unit and the contact unit are arranged side by side in a direction perpendicular to the direction of conveying the recording material.

9. An image forming apparatus comprising:

an image forming unit configured to form an image on a recording material;

a feeding unit configured to feed a recording material stacked on a staking unit;

a first detection unit configured to irradiate the recording material with light and detect the light via the recording material; and a second detection unit configured to irradiate the recording material with an ultrasonic wave and detect the ultrasonic wave via the recording material, wherein vibrations of the recording material being detected by the second detection unit with the ultrasonic wave are suppressed by a contact unit in contact with the recording material, and the first detection unit and the second detection unit are located at the downstream side of the feeding unit in the direction of conveying the recording material, wherein the recording material is at a position where the second detection unit detects the recording material when the recording material is at a position where the first detection unit detects the recording material, and wherein an image forming condition of the image forming unit is set based on results of detections performed by the first detection unit and the second detection unit.

10. The image forming apparatus according to claim 9, wherein the first detection unit and the second detection unit are located opposite each other with respect to the contact unit.

11. The image forming apparatus according to claim 9, wherein the first detection unit and the second detection unit perform respective detection operations in a state in which the recording material is stopped.

12. The image forming apparatus according to claim 9, wherein the first detection unit includes an image reading sensor configured to irradiate light to a surface of the recording material, to capture light reflected from the surface of the recording material as an image, and to detect a surface condition of the recording material based on the captured image, and wherein the first detection unit and the second detection unit perform respective detection operations substantially at the same timing.

13. The image forming apparatus according to claim 12, wherein the first detection unit detects a quantity of light reflected from the recording material and image data representing the captured image of the surface of the recording material, and the second detection unit detects the ultrasonic wave passing through the recording material.

14. The image forming apparatus according to claim 9, further comprising a recording material determination unit configured to determine a type of the recording material based on results of detections performed by the first detection unit and the second detection unit, wherein the image forming condition is set based on the type of the recording material determined by the recording material determination unit.

15. The image forming apparatus according to claim 9, wherein the second detection unit starts a detection operation earlier than the first detection unit does.

16. The image forming apparatus according to claim 9, further comprising:

a third detection unit configured to detect that a recording material is conveyed by the conveyance unit to a position where the first detection unit and the second detection unit are capable of detecting a recording material, wherein the first detection unit and the second detection unit detect the recording material based on a detection result of the third detection unit.

17. The image forming apparatus according to claim 9, wherein the first detection unit, the second detection unit and the contact unit are arranged side by side in a direction perpendicular to the direction of conveying the recording material.

18. A recording material determination apparatus configured to determine a type of a recording material, the recording material determination apparatus comprising:

a first detection unit configured to irradiate the recording material with light and detect the light via the recording material;

a second detection unit configured to irradiate the recording material with an ultrasonic wave and detect the ultrasonic wave via the recording material, wherein vibrations of the recording material being detected by the second detection unit with the ultrasonic wave are suppressed by a contact unit in contact with the recording material, and the first detection unit and the second detection unit simultaneously detect a same recording material.

19. An image forming apparatus comprising:

an image forming unit configured to form an image on a recording material;

a first detection unit configured to irradiate the recording material with light and detect the light via the recording material; and a second detection unit configured to irradiate the recording material with an ultrasonic wave and detect the ultrasonic wave via the recording material, wherein vibrations of the recording material being detected by the second detection unit with the ultrasonic wave are suppressed by a contact unit in contact with the recording material, and the first detection unit and the second detection unit simultaneously detect a same recording material.

20. A recording material determination apparatus configured to determine a type of a recording material, the recording material determination apparatus comprising:

a first detection unit configured to irradiate the recording material with light and detect the light via the recording material;

a second detection unit configured to irradiate the recording material with an ultrasonic wave and detect the ultrasonic wave via the recording material, wherein the first detection unit and the second detection unit and a contact unit configured to come into contact with the recording material so as to suppress vibrations of the recording material being detected by the second detection unit are arranged in a direction perpendicular to a direction of conveying the recording material, and the contact unit is arranged between the first detection unit and the second detection unit.

21. An image forming apparatus comprising:

an image forming unit configured to form an image on a recording material;

a first detection unit configured to irradiate the recording material with light and detect the light via the recording material; and a second detection unit configured to irradiate the recording material with an ultrasonic wave and detect the ultrasonic wave via the recording material, wherein the first detection unit and the second detection unit and a contact unit configured to come into contact with the recording material so as to suppress vibrations of the recording material being detected by the second detection unit are arranged in a direction perpendicular to a direction of conveying the recording material, and the contact unit is arranged between the first detection unit and the second detection unit.

* * * * *